US007738821B2

(12) United States Patent
Nishiwaki

(10) Patent No.: US 7,738,821 B2
(45) Date of Patent: Jun. 15, 2010

(54) DEVELOPER SUPPLY DEVICE AND IMAGE FORMING APPARATUS

(75) Inventor: Kenjiro Nishiwaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/402,596

(22) Filed: Mar. 12, 2009

(65) Prior Publication Data

US 2009/0175662 A1 Jul. 9, 2009

Related U.S. Application Data

(63) Continuation of application No. PCT/JP07/065983, filed on Aug. 10, 2007.

(30) Foreign Application Priority Data

Sep. 15, 2006 (JP) ..... 2006-251517

(51) Int. Cl.
*G03G 15/08* (2006.01)

(52) U.S. Cl. ..... 399/281; 399/270; 399/271; 399/272

(58) Field of Classification Search ..... 399/265, 399/267, 270–272, 281, 282, 285, 286
See application file for complete search history.

(56) References Cited

U.S. PATENT DOCUMENTS

| | | | |
|---|---|---|---|
| 5,027,157 A | 6/1991 | Hotomi et al. | |
| 5,142,336 A | 8/1992 | Hotomi et al. | |
| 5,946,534 A * | 8/1999 | Lewis | 399/272 |
| 6,785,498 B2 * | 8/2004 | Manno | 399/267 |
| 6,901,231 B1 | 5/2005 | Sakai et al. | |

FOREIGN PATENT DOCUMENTS

| | | |
|---|---|---|
| JP | 02-160266 | 6/1990 |
| JP | 03-012678 | 1/1991 |
| JP | 03-012679 | 1/1991 |
| JP | 07-036276 | 2/1995 |
| JP | 2003-280388 | 10/2003 |

OTHER PUBLICATIONS

International Search Report: PCT/JP2007/065983, Mailing Date: Sep. 25, 2007.

* cited by examiner

*Primary Examiner*—Hoang Ngo
(74) *Attorney, Agent, or Firm*—Banner & Witcoff, Ltd.

(57) ABSTRACT

An apparatus includes an upstream transport surface TSa which, while facing a circumferential surface DS of a developing roller 33, is disposed upstream of an area (developing area) in the vicinity of a latent image forming surface LS, and a downstream transport surface TSb which, while facing the circumferential surface, is disposed downstream of the developing area. The apparatus forms electric fields on the upstream and downstream transport surfaces for moving a charged developer T from an upstream side toward a downstream side. In the apparatus, the transport speed of developer on the upstream transport surface is higher than that on the downstream transport surface. As a result, there can be lowered a speed at which the developer which has not adhered to the circumferential surface and has reached a downstream end portion of the upstream transport surface flies out toward the vicinity of the developing area. Also, there can be avoided a problem in that the developer stagnates at an upstream end portion of the downstream transport surface with a resultant hindrance to collection of the developer.

20 Claims, 9 Drawing Sheets

DEVELOPER SUPPLY DEVICE AND IMAGE FORMING APPARATUS

This application is a continuation application of prior application Ser. No. PCT/JP2007/065983, filed Aug. 10, 2007, which claims priority to Japanese patent application no. 2006-251517, filed Sep. 15, 2006. The entire subject matter and contents of these priority applications are incorporated herein by reference.

TECHNICAL FIELD

The present invention relates to a developer supply apparatus in which a developer is transported along the circumferential surface of a developer carrying body by means of electric fields and thus adheres to the circumferential surface, and which supplies the adhering developer to a latent image forming surface on which an electrostatic latent image is formed, as well as to an image forming apparatus which includes the developer supply apparatus.

BACKGROUND ART

A conventionally known image forming apparatus is configured as follows. A developer is supplied in such a manner that the developer is uniformly distributed on the circumferential surface (developer carrying surface) of a rotatively driven developing roller without involvement of contact between the developing roller and developer supply members, such as a supply roller. A portion of the developer adhering to the circumferential surface of the developing roller adheres to the circumferential surface (latent image forming surface) of a latent image carrying body on which an electrostatic latent image is formed, at positions corresponding to the electrostatic latent image. An image in the developer adhering to the latent image forming surface is transferred onto paper, whereby the image is formed on the paper.

Such an image forming apparatus is disclosed in Japanese Patent Application Laid-Open (kokai) No. 3-12678. The disclosed image forming apparatus includes an upstream transport surface and a downstream transport surface. While facing the circumferential surface of the developing roller, the upstream transport surface is disposed upstream, with respect to the rotational direction of the developing roller, of a predetermined developing area where the circumferential surface of the developing roller and the latent image forming surface are in proximity to each other. While facing the circumferential surface of the developing roller, the downstream transport surface is disposed downstream of the developing area with respect to the rotational direction of the developing roller. In the image forming apparatus, electric fields for moving a charged developer from the upstream side toward the downstream side with respect to the rotational direction of the developing roller are formed in a space on the upstream transport surface and in a space on the downstream transport surface. By this procedure, the charged developer moves on the upstream transport surface and on the downstream transport surface, from the upstream side toward the downstream side with respect to the rotational direction of the developing roller.

When the developer is transported on the upstream transport surface, the developer disperses from the upstream transport surface toward the circumferential surface of the developing roller. As a result, the developer which has reached the circumferential surface of the developing roller adheres to the circumferential surface. In the image forming apparatus, the developing roller is not in contact with developer supply members; thus, it is possible to prevent the developing roller from being damaged due to friction or the like.

DISCLOSURE OF THE INVENTION

Meanwhile, when the developer transported on the upstream transport surface does not adhere to the circumferential surface of the developing roller and reaches a downstream end portion of the upstream transport surface, the developer flies out into a space in the vicinity of the developing area at a speed (transport speed) at which the toner has been transported. Accordingly, the higher the transport speed, the larger a developer scattering area. Thus, the scattering developer has a high possibility of dirtying paper and component members of the apparatus.

Also, when a portion of the developer not having adhered to the latent image forming surface reaches the downstream transport surface, the developer which has reached the downstream transport surface is transported on the downstream transport surface from the upstream side to the downstream side with respect to the rotational direction of the developing roller. By this procedure, the excess developer is collected. However, when the transport speed of developer on the downstream transport surface (downstream transport speed) is low, the developer which has reached the downstream transport surface is apt to stagnate at an upstream end portion of the downstream transport surface. Thus, the collection of developer is apt to be hindered. When the collection of developer is hindered, the amount of developer scattering in the space in the vicinity of the developing area increases. As a result, the developer is highly likely to adhere to the latent image forming surface at improper positions, thereby deteriorating the quality of an image formed in developer on the latent image forming surface.

As mentioned above, a conventional image forming apparatus has the risk of occurrence of the following problems. When the transport speed of developer is increased uniformly, the developer dirties paper and component members of the apparatus. When the transport speed of developer is lowered uniformly, the quality of an image formed in developer on the latent image forming surface deteriorates.

An image forming apparatus according to the present invention has been devised to cope with the above-mentioned problems.

The image forming apparatus comprises a latent image carrying body having a latent image forming surface which is an outer surface of a solid figure formed by arranging a first closed curve present on a plane in a continuously and repeatedly juxtaposed fashion in a direction orthogonal to the plane and on which an electrostatic latent image corresponding to an image to be formed is formed, and developer supply means for supplying a developer charged in a predetermined polarity to the latent image forming surface so as to cause the developer to adhere to the latent image forming surface at positions corresponding to the electrostatic latent image, and is adapted to form the image on a recording medium by means of the developer adhering to the latent image forming surface.

The developer supply means comprises:

a developer carrying body having a developer carrying surface which is an outer surface of a solid figure formed by arranging a second closed curve present on the plane in a continuously and repeatedly juxtaposed fashion in the direction orthogonal to the plane and which carries the developer charged in the polarity thereon and faces the latent image forming surface in a predetermined developing area, and adapted to move the developer carrying surface such that an arbitrary point on the developer carrying surface moves unidirectionally on a locus having the same shape as that of the second closed curve;

upstream developer transport means having an upstream transport surface disposed in such a manner as to face, with a predetermined distance therebetween, a portion of the developer carrying surface located upstream of the developing area with respect to a moving direction of the developer carrying surface, and adapted to form, in a space between the upstream transport surface and the developer carrying surface, upstream transport electric fields for moving the developer charged in the polarity on the upstream transport surface at a predetermined upstream transport speed from an upstream side toward a downstream side with respect to the moving direction of the developer carrying surface; and downstream developer transport means having a downstream transport surface disposed in such a manner as to face, with a predetermined distance therebetween, a portion of the developer carrying surface located downstream of the developing area with respect to the moving direction of the developer carrying surface, and adapted to form, in a space between the downstream transport surface and the developer carrying surface, downstream transport electric fields for moving the developer charged in the polarity on the downstream transport surface at a downstream transport speed higher than the upstream transport speed from the upstream side toward the downstream side with respect to the moving direction of the developer carrying surface.

According to the above-mentioned configuration, the developer is transported on the upstream transport surface at a relatively low upstream transport speed. Thus, when the developer transported on the upstream transport surface does not adhere to the developer carrying surface (e.g., the circumferential surface of a developing roller) and reaches a downstream end portion of the upstream transport surface, a speed at which the developer flies out toward a space in the vicinity of the developing area is lowered. Accordingly, an area in which the developer scatters can be prevented from becoming excessively large. As a result, there can be avoided a problem in that the scattered developer dirties paper and component members of the apparatus.

Furthermore, even when the developer which does not adhere to the latent image forming surface and reaches the downstream transport surface is relatively large in amount, since the developer on the downstream transport surface is transported at a relatively high downstream transport speed, there can be prevented the stagnation of developer at an upstream end portion of the downstream transport surface. Thus, a hindrance to the collection of the developer can be avoided. As a result, since an increase in the amount of developer scattering in a space in the vicinity of the developing area can be restrained, adhesion of the developer to the latent image forming surface at improper positions can be prevented, thereby avoiding a deterioration in the quality of an image formed in developer on the latent image forming surface.

In this case, preferably, the upstream transport speed in the upstream developer transport means is lower than the moving speed of the developer carrying surface.

In the case of non-uniform distribution (occurrence of distribution unevenness) of the developer moving on the upstream transport surface, if the moving speed of the developer carrying surface (developer carrying surface moving speed) is equal to the upstream transport speed, even though a certain portion of the developer carrying surface moves with the elapse of time, a portion of the upstream transport surface which faces the certain portion of the developer carrying surface remains unchanged in the distribution of developer. As a result, the non-uniform distribution of developer on the upstream transport surface may be transferred onto the developer carrying surface, resulting in non-uniform distribution of developer adhering to the developer carrying surface.

By contrast, according to the above-mentioned configuration, the developer carrying surface moving speed and the upstream transport speed differ from each other. Accordingly, when time elapses from a first point of time to a second point of time, a difference arises between the moving distance of a certain portion of the developer carrying surface and the moving distance of the developer present at a portion of the upstream transport surface which faces the certain portion of the developer carrying surface at the first point of time. That is, in the case where distribution unevenness exists with respect to the developer on the upstream transport surface, the distribution of the developer present at a portion of the upstream transport surface which faces the certain portion of the developer carrying surface varies with the elapse of time. As a result, as compared with the case where the developer carrying surface moving speed and the upstream transport speed are equal to each other, the degree of influence of the distribution unevenness of developer on the upstream transport surface on the distribution of developer adhering to the developer carrying surface can be reduced. Therefore, the distribution of developer on the developer carrying surface can be brought close to uniform distribution.

Furthermore, when the developer transported on the upstream transport surface does not adhere to the developer carrying surface and reaches a downstream end portion of the upstream transport surface, the speed at which the developer flies out toward a space in the vicinity of the developing area is lower as compared with the case where the upstream transport speed is higher than the developer carrying surface moving speed. Accordingly, an area in which the developer scatters can be prevented from becoming excessively large.

In this case, preferably, the downstream transport speed in the downstream developer transport means is higher than the moving speed of the developer carrying surface.

When the developer adhering to the developer carrying surface reaches the developing area, mainly the developer which is present at positions corresponding to an electrostatic latent image formed on the latent image forming surface moves onto the latent image forming surface. Accordingly, a portion of the developer carrying surface located downstream of the developing area mixedly has an area where the developer is absent due to movement of the developer onto the latent image forming surface (an area where developer concentration is relatively low) and an area where the developer remains adhering (an area where developer concentration is relatively high).

If the moving speed of the developer carrying surface (developer carrying surface moving speed) is equal to the downstream transport speed, even though a certain portion of the developer carrying surface moves with the elapse of time, a portion of the downstream transport surface which faces the certain portion of the developer carrying surface remains unchanged in the distribution of developer. Accordingly, as a result of the developer moving from the developer carrying surface to the downstream transport surface, a portion of the downstream transport surface which faces an area of the developer carrying surface where developer concentration is relatively high becomes relatively high in developer concentration. As a result, the developer aggregates at the portion of the downstream transport surface, so that there has been the risk of the developer encountering difficulty in transport.

By contrast, according to the above-mentioned configuration, the developer carrying surface moving speed and the downstream transport speed differ from each other. Accordingly, when time elapses from a first point of time to a second point of time, a difference arises between the moving distance of a certain portion of the developer carrying surface and the moving distance of the developer present at a portion of the downstream transport surface which faces the certain portion of the developer carrying surface at the first point of time. That is, the distribution of the developer present at a portion of the downstream transport surface which faces the certain portion of the developer carrying surface varies with the elapse of time. As a result, the distribution on the downstream transport surface of the developer having moved from the developer carrying surface to the downstream transport surface can be brought close to uniform distribution. Therefore, the concentration of developer in an arbitrary area on the downstream transport surface can be prevented from becoming excessively high, thereby avoiding occurrence of difficulty in transport of the developer which could otherwise result from aggregation of the developer.

Furthermore, even when the developer which does not adhere to the latent image forming surface and reaches the downstream transport surface is relatively large in amount, since the developer on the downstream transport surface is transported at the downstream transport speed higher than the developer carrying surface moving speed, there can be more reliably prevented the stagnation of developer at an upstream end portion of the downstream transport surface as compared with the case where the downstream transport speed is lower than the developer carrying surface moving speed. Thus, a hindrance to the collection of the developer can be avoided. As a result, since an increase in the amount of developer scattering in a space in the vicinity of the developing area can be restrained, adhesion of the developer to the latent image forming surface at improper positions can be prevented, thereby avoiding a deterioration in the quality of an image formed in developer on the latent image forming surface.

In this case, preferably, the upstream developer transport means forms the upstream transport electric fields such that average electric fields obtained by time-averaging components of the upstream transport electric fields which are orthogonal to the upstream transport surface at respective arbitrary points on the upstream transport surface function to move the developer charged in the polarity present on the upstream transport surface from the upstream transport surface toward the developer carrying surface.

According to the above-mentioned configuration, the developer on the upstream transport surface can be caused to more reliably adhere to the developer carrying surface. As a result, the developer which does not adhere to the developer carrying surface and reaches a downstream end portion of the upstream transport surface can be reduced in amount, whereby the amount of developer flying out toward a space in the vicinity of the developing area can be reduced.

In this case, preferably, the downstream developer transport means forms the downstream transport electric fields such that average electric fields obtained by time-averaging components of the downstream transport electric fields which are orthogonal to the downstream transport surface at respective arbitrary points on the downstream transport surface function to move the developer charged in the polarity present on the developer carrying surface from the developer carrying surface toward the downstream transport surface.

In the above-mentioned image forming apparatus, the developer is supplied uniformly to the developer carrying surface in an area located upstream of the developing area. Accordingly, if the developer which has not moved from the developer carrying surface to the latent image forming surface reaches the area located upstream of the developing area while remaining adhering to the developer carrying surface, an area where the developer remains becomes higher in developer concentration than an area where the developer does not remain. Consequently, the distribution of developer on the developer carrying surface becomes non-uniform distribution. As a result, the quality of an image formed in developer on the latent image forming surface may deteriorate (a developing ghost or the like may occur).

By contrast, according to the above-mentioned configuration, the developer which has not moved to the latent image forming surface and remains adhering to the developer carrying surface can be reliably removed from the developer carrying surface in an area located downstream of the developing area, thereby preventing the developer from reaching the above-mentioned area located upstream of the developing area while remaining adhering to the developer carrying surface. Therefore, the distribution of developer on the developer carrying surface in the area located upstream of the developing area can be brought closer to uniform distribution.

A developer supply apparatus according to the present invention comprises:

a developer carrying body having a developer carrying surface which is an outer surface of a solid figure formed by arranging a second closed curve present on a plane in a continuously and repeatedly juxtaposed fashion in a direction orthogonal to the plane and which carries a developer charged in a predetermined polarity thereon and faces, in a predetermined developing area, a latent image forming surface which is an outer surface of a solid figure formed by arranging a first closed curve present on the plane in a continuously and repeatedly juxtaposed fashion in the direction orthogonal to the plane and on which an electrostatic latent image is formed, and adapted to move the developer carrying surface such that an arbitrary point on the developer carrying surface moves unidirectionally on a locus having the same shape as that of the second closed curve;

upstream developer transport means having an upstream transport surface disposed in such a manner as to face, with a predetermined distance therebetween, a portion of the developer carrying surface located upstream of the developing area with respect to a moving direction of the developer carrying surface, and adapted to form, in a space between the upstream transport surface and the developer carrying surface, upstream transport electric fields for moving the developer charged in the polarity on the upstream transport surface at a predetermined upstream transport speed from an upstream side toward a downstream side with respect to the moving direction of the developer carrying surface; and downstream developer transport means having a downstream transport surface disposed in such a manner as to face, with a predetermined distance therebetween, a portion of the developer carrying surface located downstream of the developing area with respect to the moving direction of the developer carrying surface, and adapted to form, in a space between the downstream transport surface and the developer carrying surface, downstream transport electric fields for moving the developer charged in the polarity on the downstream transport surface at a downstream transport speed higher than the upstream transport speed from the upstream side toward the downstream side with respect to the moving direction of the developer carrying surface.

Furthermore, the developer supply apparatus supplies the developer charged in the polarity and carried on the developer carrying surface to the latent image forming surface in the developing area so as to cause the supplied developer to adhere to the latent image forming surface at positions corresponding to the electrostatic latent image.

According to the above-mentioned configuration, the developer is transported on the upstream transport surface at a relatively low upstream transport speed. Accordingly, when the developer transported on the upstream transport surface does not adhere to the developer carrying surface and reaches a downstream end portion of the upstream transport surface, a speed at which the developer flies out toward a space in the vicinity of the developing area is lowered. Thus, an area in which the developer scatters can be prevented from becoming excessively large. As a result, there can be avoided a problem in that the scattered developer dirties paper and component members of the apparatus.

Furthermore, even when the developer which does not adhere to the latent image forming surface and reaches the downstream transport surface is relatively large in amount, since the developer on the downstream transport surface is transported at a relatively high downstream transport speed, there can be prevented the stagnation of developer at an upstream end portion of the downstream transport surface. Thus, a hindrance to the collection of the developer can be avoided. As a result, since an increase in the amount of developer scattering in a space in the vicinity of the developing area can be restrained, adhesion of the developer to the latent image forming surface at improper positions can be prevented, thereby avoiding a deterioration in the quality of an image formed in developer on the latent image forming surface.

BEST MODE FOR CARRYING OUT THE INVENTION

<Configuration>

An image forming apparatus including a developer supply apparatus according to an embodiment of the present invention will next be described with reference to the drawings. The image forming apparatus is a laser printer (image forming apparatus) 10 whose schematic side sectional view is shown in FIG. 1 and which is adapted to perform monochromatic printing.

Figure 1:
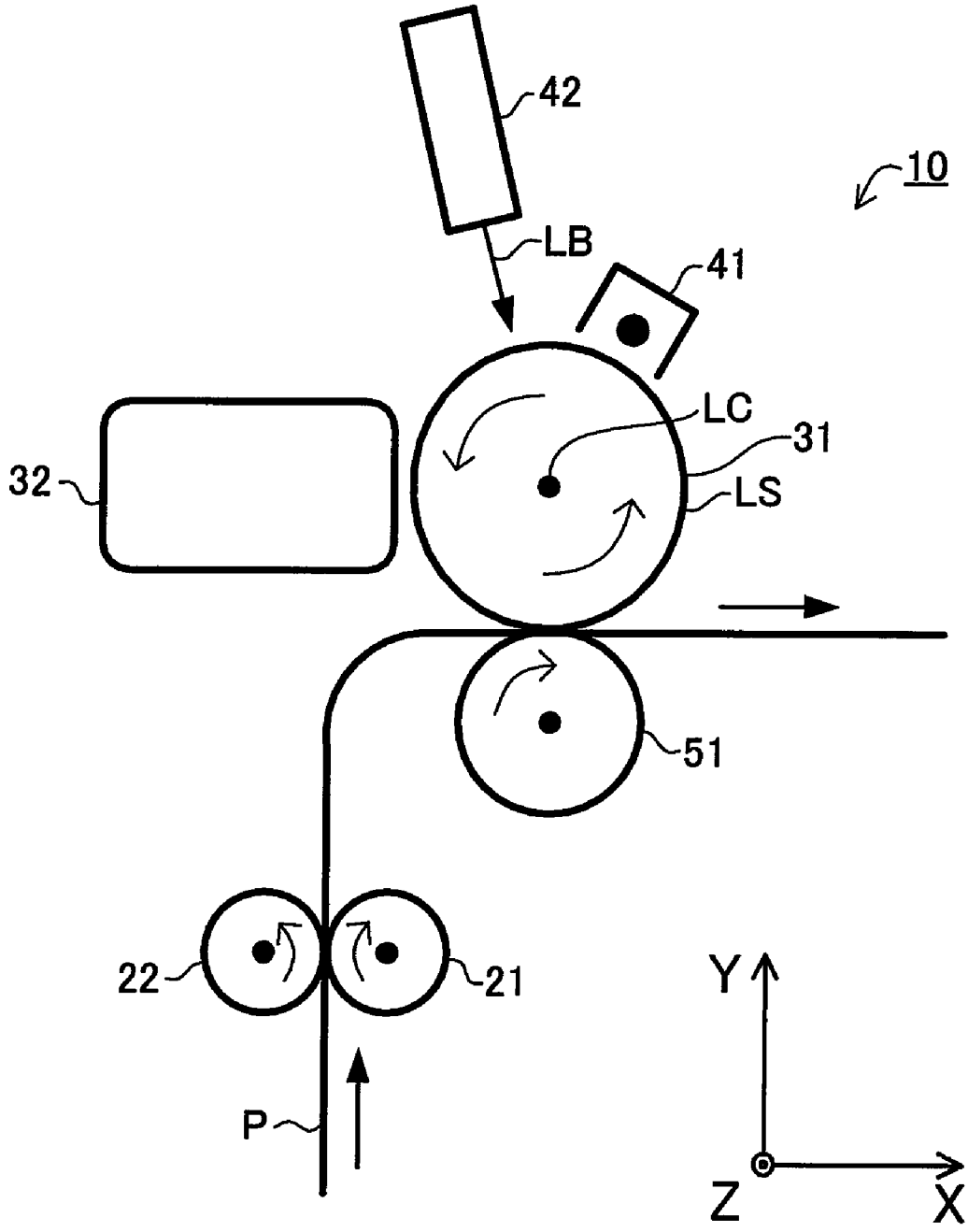
FIG. 1 is a schematic side sectional view of an image forming apparatus according to an embodiment of the present invention.

As shown in FIG. 1, the laser printer 10 includes a pair of resist rollers 21 and 22; a photoconductor drum 31, which serves as a latent image carrying body; a developer supply apparatus 32, which serves as developer supply means; a charger 41; a scanner unit 42; and a transfer roller 51. The photoconductor drum 31 and the developer supply apparatus 32 constitute a process unit.

The laser printer 10 accommodates paper P, which serves as a recording medium, in a stacked condition within an unillustrated paper feed tray. The laser printer 10 is configured such that the accommodated paper P is sent out sheet by sheet toward the resist rollers 21 and 22. The resist rollers 21 and 22 send out the received paper P toward a gap between the photoconductor drum 31 and the transfer roller 51 at predetermined timing.

Figure 2:
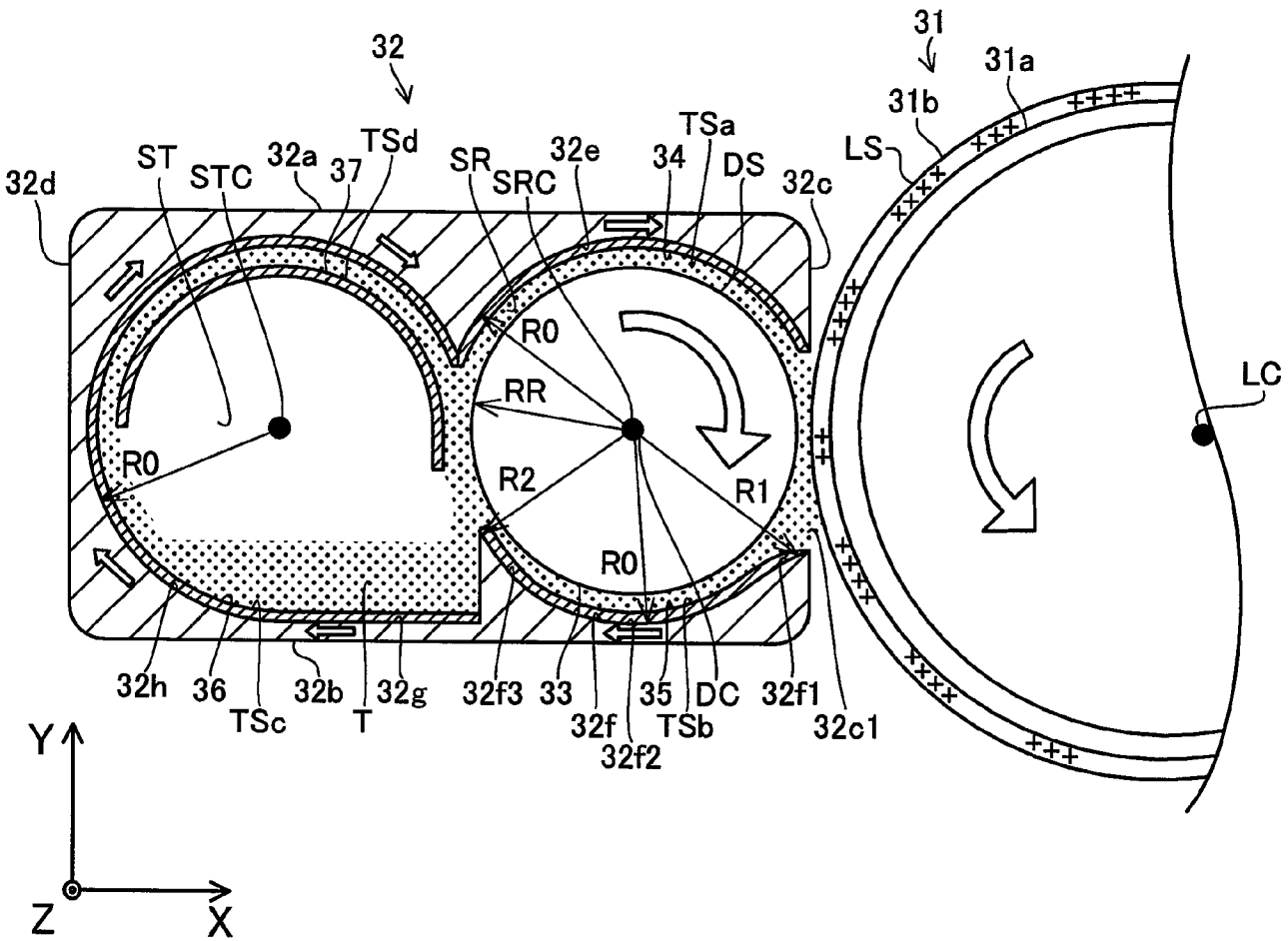
FIG. 2 is an enlarged sectional view showing a developer supply apparatus and a portion of a photoconductor drum on a side toward the developer supply apparatus, the developer supply apparatus and the photoconductor drum being shown in FIG. 1.

As partially shown in FIG. 2, the photoconductor drum 31 includes a cylindrical drum body 31*a* having a center axis LC parallel to a Z-axis, and a photoconductive layer 31*b* formed on the outer circumferential surface of the drum body 31*a*. The drum body 31*a* is formed of an electrically conductive material (in the present embodiment, metal). A predetermined bias is applied to the drum body 31*a* (in the present embodiment, the drum body 31*a* is grounded so as to assume an electric potential of 0 V).

The photoconductive layer 31*b* is formed of a positively chargeable photoconductor (in the present embodiment, a material which contains polycarbonate as a main component). That is, when the photoconductive layer 31*b* which is substantially uniformly charged in positive polarity (positively charged) is exposed to light, an exposed portion of the photoconductive layer 31*b* becomes photoconductive and thus reduces in the absolute value (magnitude) of the amount of charge. The photoconductor drum 31 rotates counterclockwise in FIGS. 1 and 2. The outer surface of the photoconductive layer 31*b* is herein called a latent image forming surface LS. The latent image forming surface LS can also be said to be the outer surface of a solid figure formed by arranging a circle, which serves as a first closed curve, present on an XY plane, which contains an X-axis orthogonal to the Z-axis, and a Y-axis orthogonal to the X-axis and to the Z-axis, in a continuously and repeatedly juxtaposed fashion in the Z-axis direction orthogonal to the XY plane.

As shown on an enlarged scale in FIG. 2, the developer supply apparatus 32 assumes the form of a substantially rectangular parallelepiped and has a top face 32*a* and a bottom face 32*b*, which are planes orthogonal to the Y-axis; unillustrated two side faces, which are planes orthogonal to the Z-axis; and a front face 32*c* and a rear face 32*d*, which are planes orthogonal to the X-axis. The length of the developer supply apparatus 32 along the Z-axis direction is substantially equal to that of the photoconductor drum 31 along the Z-axis direction.

The front face 32*c* is disposed in such a manner as to face the latent image forming surface LS with a small distance therebetween. The front face 32*c* has a developing hole 32*c*1. The developing hole 32*c*1 opens in the form of a rectangle whose long sides are parallel to the Z-axis and have a length substantially equal to that of the photoconductor drum 31 along the Z-axis direction and whose short sides are parallel to the Y-axis.

The developer supply apparatus 32 internally has a developer containing space ST and a roller containing space SR. Each of the developer containing space ST and the roller containing space SR is a substantially cylindrical space which has a center axis parallel to the Z-axis and a radius of about a distance R0. Each of the developer containing space ST and the roller containing space SR has a length along the Z-axis direction substantially equal to that of the photoconductor drum 31.

A center axis STC of the developer containing space ST and a center axis SRC of the roller containing space SR are contained in a single plane orthogonal to the Y-axis and are juxtaposed in this order in the X-axis positive direction. An end portion of the developer containing space ST located on a side toward the X-axis positive direction and an end portion of the roller containing space SR located on a side toward the X-axis negative direction are in contact with each other. That is, the developer containing space ST and the roller containing space SR communicate with each other. Furthermore, the roller containing space SR is in contact with the developing hole 32*c*1 at its end portion located on the side toward the X-axis positive direction. That is, the roller containing space SR communicates with the exterior of the developer supply apparatus 32.

Accordingly, two wall surfaces disposed apart from each other in the Y-axis direction radially demarcate the roller containing space SR. Of the two wall surfaces, one located on a side toward the top face 32*a* is herein called an upstream wall surface 32*e*, and one located on a side toward the bottom face 32*b* is called a downstream wall surface 32*f*. The upstream wall surface 32*e* is formed such that the distance between an arbitrary position on the upstream wall surface 32*e* and the center axis SRC of the roller containing space SR coincides with the above-mentioned distance R0.

The downstream wall surface 32*f* includes an upstream portion 32*f*1, a middle-reach portion 32*f*2, and a downstream portion 32*f*3. The upstream portion 32*f*1, the middle-reach portion 32*f*2, and the downstream portion 32*f*3 are juxtaposed in this order toward the X-axis negative direction from an end portion of the downstream wall surface 32*f* located on the side toward the X-axis positive direction.

The upstream portion 32*f*1 is formed such that a distance R1 between an arbitrary position on the upstream portion 32*f*1 and the center axis SRC of the roller containing space SR is longer than the above-mentioned distance R0.

The middle-reach portion 32*f*2 is formed such that the distance between an arbitrary position on the middle-reach portion 32*f*2 and the center axis SRC of the roller containing space SR coincides with the above-mentioned distance R0.

The downstream portion 32*f*3 is formed such that a distance R2 between an arbitrary position on the downstream portion 32*f*3 and the center axis SRC of the roller containing space SR is shorter than the above-mentioned distance R0.

Meanwhile, a single continuous wall surface radially demarcates the developer containing space ST. A portion of the wall surface located on a side toward the bottom face 32*b* and toward the X-axis positive direction is herein called a plane portion 32*g*, and the remaining portion (a portion located on the side toward the bottom face 32*b* and toward the X-axis negative direction from the plane portion 32*g*, a portion located on a side toward the rear face 32*d*, and a portion located on a side toward the top face 32*a*) is called a curved surface portion 32*h*.

The plane portion 32*g* assumes the form of a plane parallel to the bottom face 32*b*. The curved surface portion 32*h* is formed such that the distance between an arbitrary position on the curved surface portion 32*h* and the center axis STC of the developer containing space ST coincides with the above-mentioned distance R0. A dry, particulate, black developer (in the present embodiment, a non-magnetic, one-component, polymeric toner) T is placed on the plane portion 32*g* and on a portion of the curved surface portion 32*h* located on the side toward the bottom face 32*b*. That is, the developer T is contained in the developer containing space ST.

The developer supply apparatus 32 includes a developing roller 33, which serves as a developer carrying body; an upstream transport body 34, which serves as upstream developer transport means; a downstream transport body 35, which serves as downstream developer transport means; an intra-developer-containing-space transport body 36; and an auxiliary transport body 37.

The developing roller 33 is a columnar member. The developing roller 33 is configured such that its shaft portion is formed of a metal material, whereas its circumferential portion is formed of an electrically conductive rubber material. A radius RR (in the present embodiment, 10 mm) of the developing roller 33 is smaller than the above-mentioned distance R0. The axial length of the developing roller 33 is slightly shorter than that of the roller containing space SR. The outer circumferential surface of the developing roller 33 is herein also called a developer carrying surface DS. The developer carrying surface DS can also be said to be the outer surface of a solid figure formed by arranging a circle, which serves as a second closed curve, present on the above-mentioned XY plane in a continuously and repeatedly juxtaposed fashion in the Z-axis direction orthogonal to the XY plane.

The developing roller 33 is contained in the roller containing space SR in such a manner as to be coaxial with the roller containing space SR. By virtue of this configuration, an end portion of the developer carrying surface DS located on the side toward the X-axis positive direction faces the developing hole 32*c*1, thereby facing the latent image forming surface LS of the photoconductor drum 31 with a predetermined distance (in the present embodiment, 0.1 mm) therebetween. Notably, an area where the developer carrying surface DS faces the latent image forming surface LS is herein also called a developing area.

The developing roller 33 is supported by the developer supply apparatus 32 and rotates clockwise in FIGS. 1 and 2. Accordingly, the developer carrying surface DS of the developing roller 33 moves such that an arbitrary point on the developer carrying surface DS moves unidirectionally on a locus having the same shape as that of the above-mentioned second closed curve.

A shaft portion of the developing roller 33 is connected to an unillustrated bias circuit for applying bias thereto such that the developer carrying surface DS assumes a predetermined electric potential for causing the developer to appropriately adhere to (for appropriately carrying the developer on) the circumferential surface (latent image forming surface LS) of the photoconductor drum 31 (in the present embodiment, a voltage is applied such that the developer carrying surface DS assumes an electric potential of +500 V).

The upstream transport body 34 is a sheet-like member having a fixed thickness. The upstream transport body 34 is fixed on the upstream wall surface 32*e* in such a manner as to cover the upstream wall surface 32*e*. That is, the upstream transport body 34 is disposed in such a manner as to face a portion of the developer carrying surface DS located upstream of the developing area with respect to the rotational direction of the developing roller 33 (the moving direction of the developer carrying surface DS) with a predetermined distance (in the present embodiment, 1 mm) therebetween. The surface of the upstream transport body 34 which faces the developer carrying surface DS is herein also called an upstream transport surface TSa.

Figure 3:
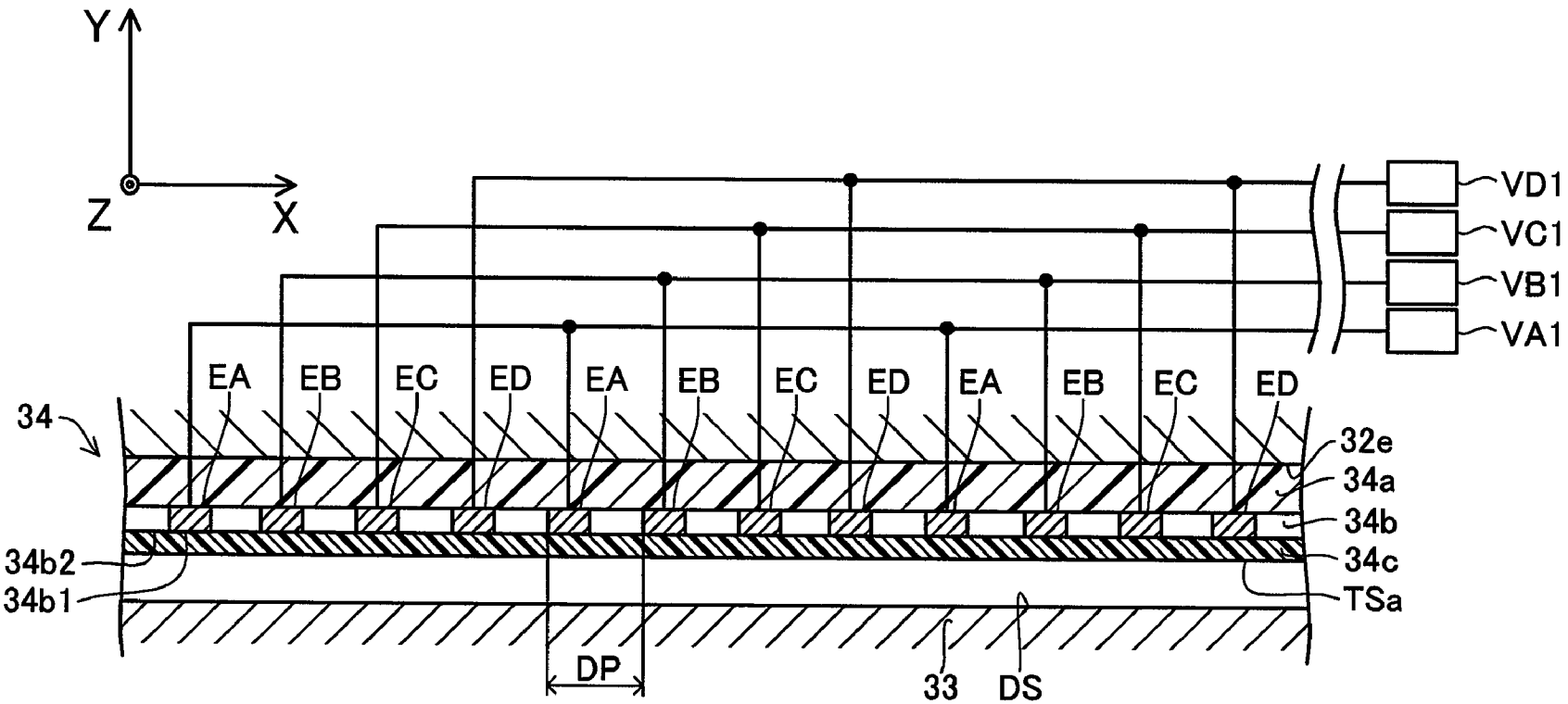
FIG. 3 is an enlarged sectional view partially showing an upstream transport body and a developing roller shown in FIG. 2.

As shown in FIG. 3, which is an enlarged view showing a portion of the upstream transport body 34 closest to the top face 32*a*, the upstream transport body 34 has a structure consisting of three layers each having a predetermined thickness (3-layer structure). Specifically, the upstream transport body 34 includes a substrate 34*a*, which is a layer (bottom layer) furthest from the developer carrying surface DS; an electrode formation layer 34*b*, which is a layer (intermediate layer) second furthest from the developer carrying surface DS after the substrate 34*a*; and a surface film 34*c*, which is a layer (top layer) closest to the developer carrying surface DS.

The substrate 34*a* is formed of an electrically insulative material (in the present embodiment; an electrically insulative resin). The electrode formation layer 34*b* includes a plurality of electrodes 34*b*1 (or EA, EB, EC, and ED) and an inter-electrode insulator 34*b*2.

The plurality of electrodes 34*b*1 are formed of an electrically conductive material (in the present embodiment, metal). Each of the electrodes 34*b*1 assumes, as viewed in plane, the form of a rectangle having long sides parallel to the Z-axis and short sides extending in a substrate surface direction (X-axis direction for a portion shown in FIG. 3), which is orthogonal to the Z-axis and along the upstream wall surface 32*e*, and also assumes the form of a substantially rectangular parallelepiped having a predetermined height. The electrodes 34*b*1 are disposed on the surface of the substrate 34*a* located on a side toward the developer carrying surface DS while being equally spaced along the substrate surface direction.

Power circuits VA1 to VD1, which partially constitute the upstream developer transport means, are repeatedly connected in this order to the electrodes 34*b*1 in a one-to-one correspondence from an end portion (upstream end portion) of the upstream transport body 34 located on the side toward the X-axis negative direction, toward an end portion (downstream end portion) of the upstream transport body 34 located on the side toward the X-axis positive direction. That is, the power circuit VB1 is connected to the electrode 34*b*1 (electrode EB) which is adjacently located on the side toward the X-axis positive direction of the electrode 34*b*1 (electrode EA) to which the power circuit VA1 is connected. The power circuit VC1 is connected to the electrode 34*b*1 (electrode EC) which is adjacently located on the side toward the X-axis positive direction of the electrode EB. The power circuit VD1 is connected to the electrode 34*b*1 (electrode ED) which is adjacently located on the side toward the X-axis positive direction of the electrode EC. The power circuit VA1 is connected to the electrode 34*b*1 (electrode EA) which is adjacently located on the side toward the X-axis positive direction of the electrode ED.

The inter-electrode insulator 34*b*2 is formed of an electrically insulative material (in the present embodiment, an electrically insulative resin). The inter-electrode insulator 34*b*2 is charged into a space between two adjacent electrodes 34*b*1. The surface of the inter-electrode insulator 34*b*2 located on a side toward the developer carrying surface DS is flush with those of the electrodes 34*b*1. Through employment of this configuration, the inter-electrode insulator 34*b*2 prevents short circuit between the adjacent electrodes 34*b*1.

The present embodiment employs an electrode pitch length DP of 0.2 mm. The electrode pitch length DP is the length of a single intermediate-layer component element consisting of one electrode 34*b*1 and the inter-electrode insulator 34*b*2 adjacently located on the side toward the X-axis positive direction of the electrode 34*b*1.

The surface film 34*c* is formed by application on the surface of the electrode formation layer 34*b* (the electrodes 34*b*1 and the inter-electrode insulator 34*b*2), which serves as an intermediate layer, the surface being located on the side toward the developer carrying surface DS. The surface film 34*c* is formed of a material which charges the developer T to positive polarity (a material which positively charges the developer T) by means of friction (contact) between the surface film 34*c* and the developer T.

As shown in FIG. 2, similar to the upstream transport body 34, the downstream transport body 35 is a sheet-like member. The downstream transport body 35 is fixed on the downstream wall surface 32*f* in such a manner as to cover the downstream wall surface 32*f*. That is, the downstream transport body 35 is disposed in such a manner as to face a portion of the developer carrying surface DS located downstream of the developing area with respect to the rotational direction of the developing roller 33 (the moving direction of the developer carrying surface DS) with a predetermined distance therebetween. The surface of the downstream transport body 35 which faces the developer carrying surface DS is herein also called an downstream transport surface TSb.

Figure 4:
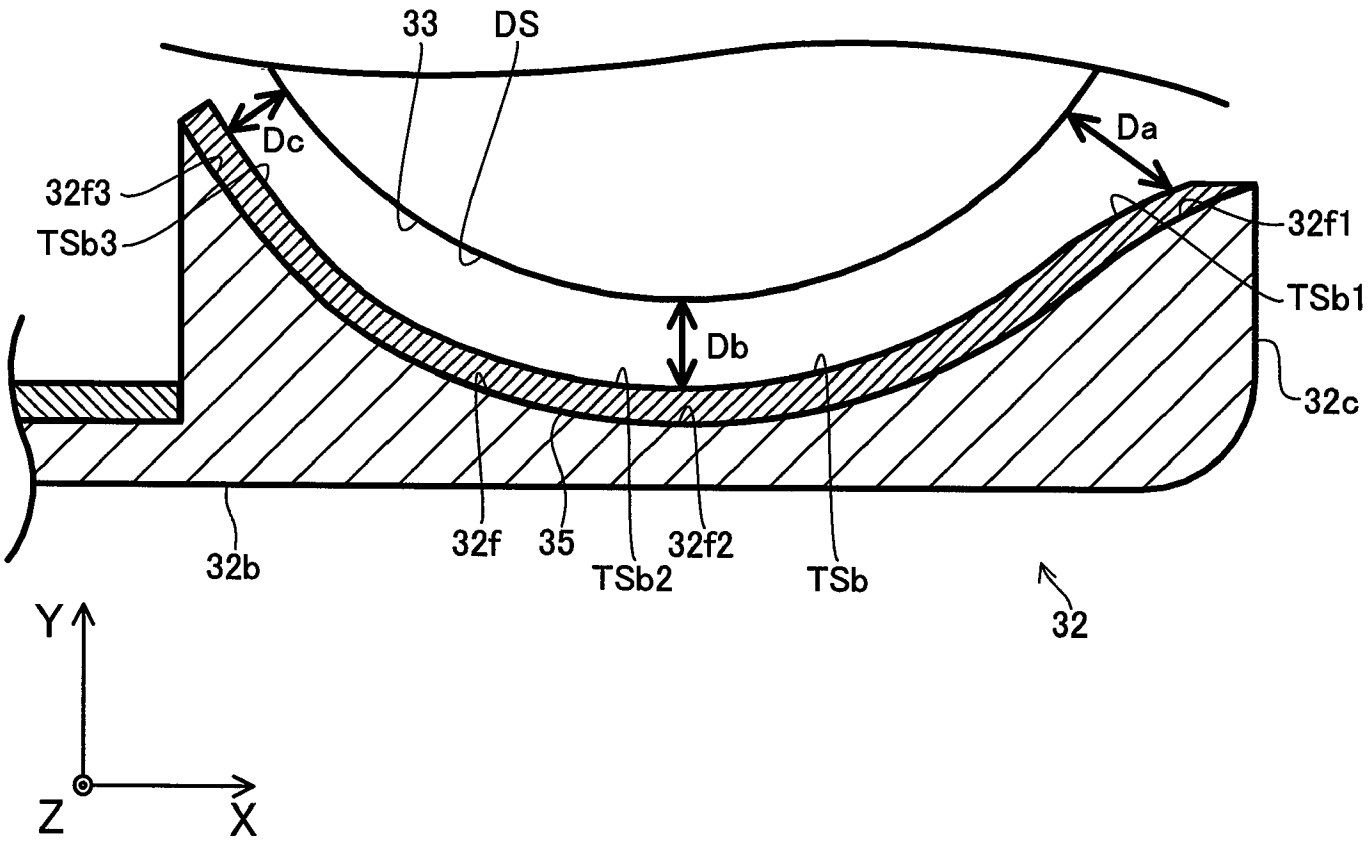
FIG. 4 is an enlarged sectional view showing an area where the developing roller of the developer supply apparatus and a downstream transport body face each other, the developer supply apparatus and the downstream transport body being shown in FIG. 2.

According to the above-mentioned configuration, as shown in FIG. 4, which shows the downstream transport body 35 on an enlarged scale, an upstream portion TSb1 of the downstream transport surface TSb which is fixed on the upstream portion 32*f*1 is such that a shortest distance Da between the developer carrying surface DS and an arbitrary position on the upstream portion TSb1 is longer than a shortest distance Db (in the present embodiment, 1 mm) between the developer carrying surface DS and an arbitrary position on a middle-reach portion TSb2 of the downstream transport surface TSb on the middle-reach portion 32*f*2. Furthermore, a downstream portion TSb3 of the downstream transport surface TSb which is fixed on the downstream portion 32*f*3 is such that a shortest distance Dc between the developer carrying surface DS and an arbitrary position on the downstream portion TSb3 is shorter than the shortest distance Db between the developer carrying surface DS and an arbitrary position on the middle-reach portion TSb2 of the downstream transport surface TSb on the middle-reach portion 32*f*2.

Figure 5:
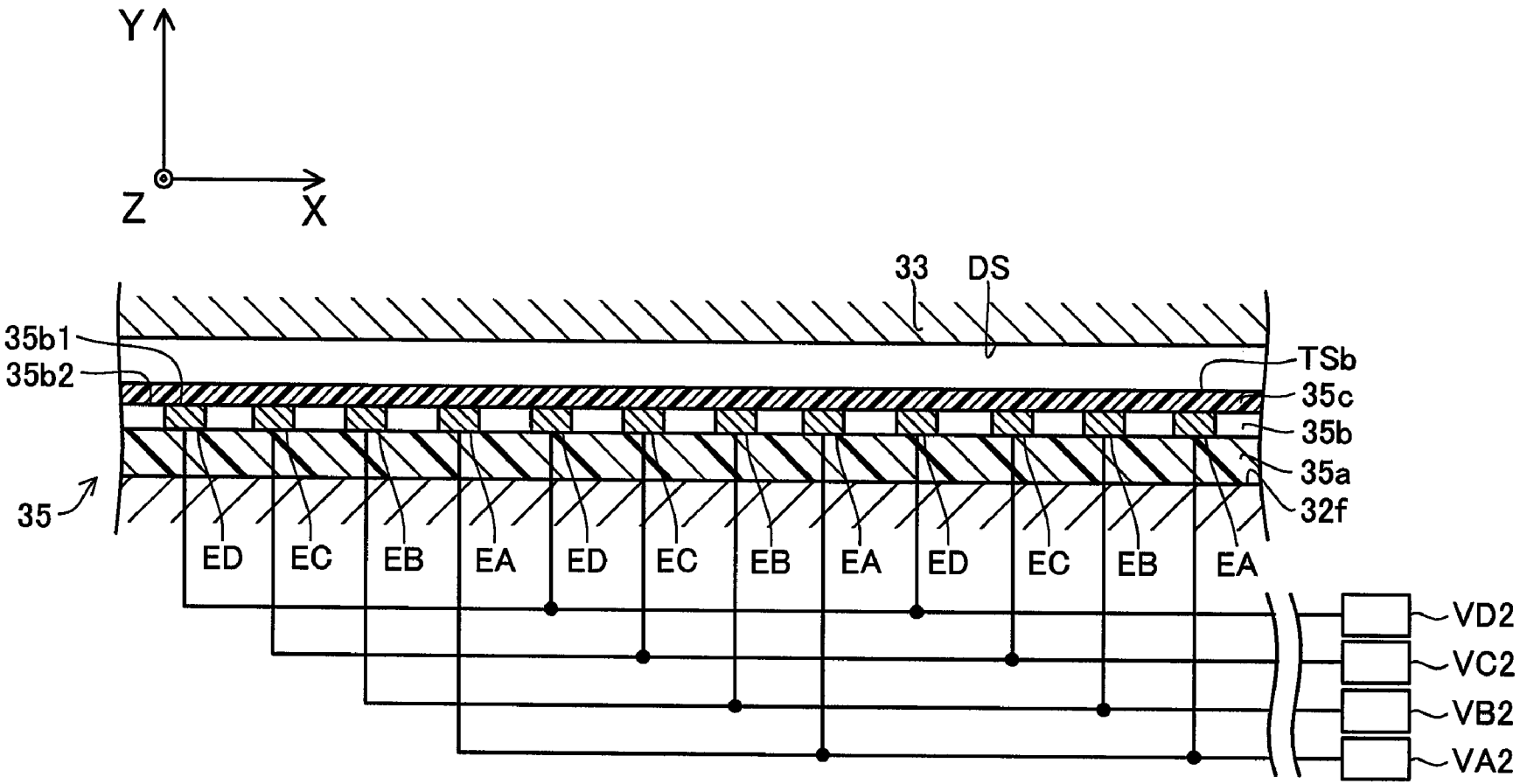
FIG. 5 is an enlarged sectional view partially showing the downstream transport body and the developing roller shown in FIG. 2.

As shown in FIG. 5, which is an enlarged view showing a portion of the downstream transport body 35 closest to the bottom face 32*b*, similar to the upstream transport body 34, the downstream transport body 35 has a 3-layer structure consisting of: a substrate 35*a*, which is a layer furthest from the developer carrying surface DS; an electrode formation layer 35*b*, which is a layer second furthest from the developer carrying surface DS after the substrate 35*a*; and a surface film 35*c*, which is a layer closest to the developer carrying surface DS. The electrode formation layer 35*b* includes a plurality of electrodes 35*b*1 (or EA, EB, EC, and ED). Power circuits VA2 to VD2, which partially constitute the downstream developer transport means, are repeatedly connected in this order to the electrodes 35*b*1 in a one-to-one correspondence from an end portion (upstream end portion) of the downstream transport body 35 located on the side toward the X-axis positive direction, toward an end portion (downstream end portion) of the downstream transport body 35 located on the side toward the X-axis negative direction.

As shown in FIG. 2, similar to the upstream transport body 34, the intra-developer-containing-space transport body 36 is a sheet-like member. The intra-developer-containing-space transport body 36 is fixed to the plane portion 32*g* and to the curved surface portion 32*h* in such a manner as to cover the plane portion 32*g* and the curved surface portion 32*h*. A surface of the intra-developer-containing-space transport body 36 opposite that in contact with the plane portion 32*g* and the curved surface portion 32*h* is herein called an intra-developer-containing-space transport surface TSc.

Figure 6:
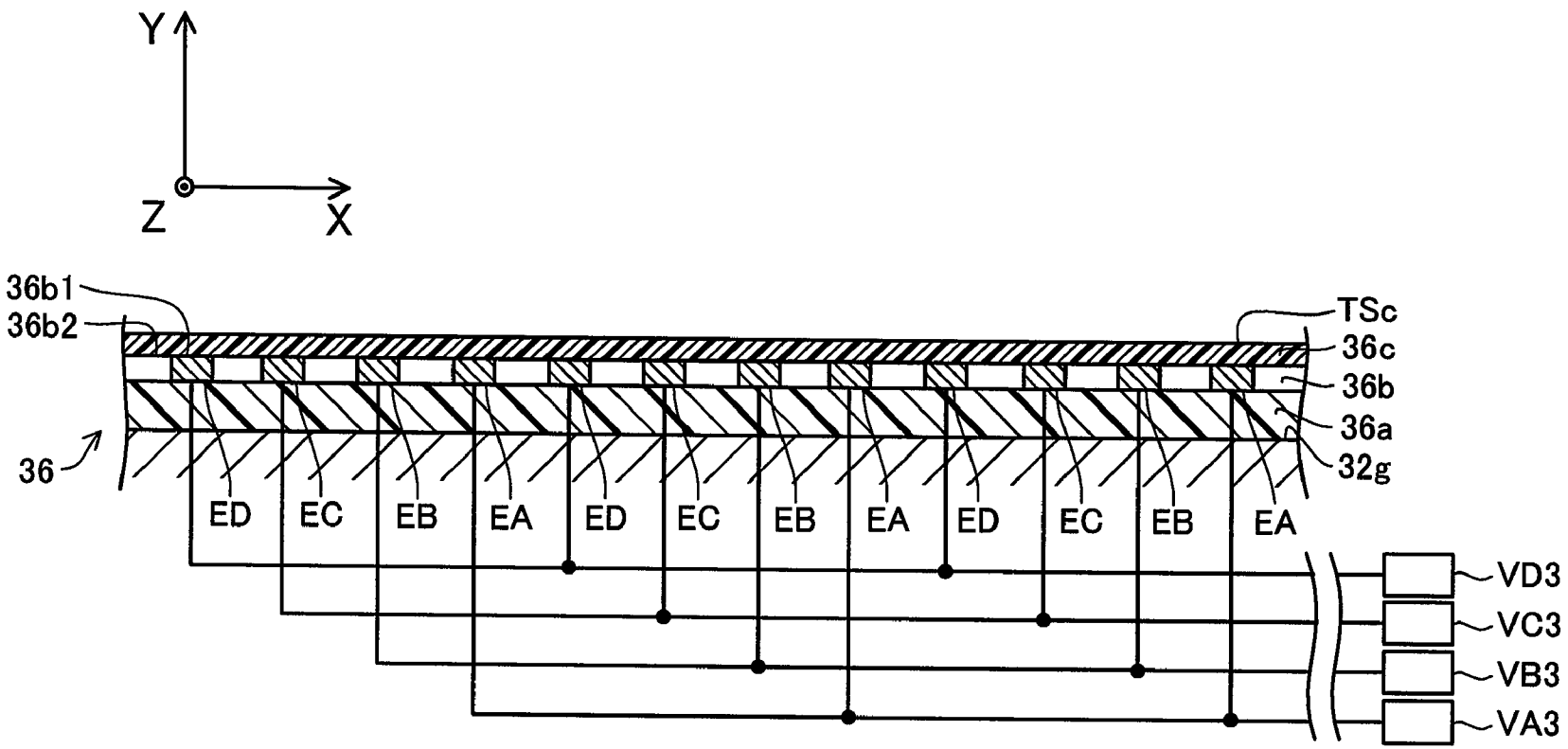
FIG. 6 is an enlarged sectional view partially showing an intra-developer-containing-space transport body shown in FIG. 2.

As shown in FIG. 6, which is an enlarged view showing a portion of the intra-developer-containing-space transport body 36 fixed to the plane portion 32*g*, similar to the upstream transport body 34, the intra-developer-containing-space transport body 36 has a 3-layer structure consisting of: a substrate 36*a*, which is a layer closest to the plane portion 32*g*; an electrode formation layer 36*b*, which is a layer second closest to the plane portion 32*g* after the substrate 36*a*; and a surface film 36*c*, which is a layer furthest from the plane portion 32*g*.

The electrode formation layer 36*b* includes a plurality of electrodes 36*b*1 (or EA, EB, EC, and ED). Power circuits VA3 to VD3 are repeatedly connected in this order to the electrodes 36*b*1 in a one-to-one correspondence from an end portion (upstream end portion) of the intra-developer-containing-space transport body 36 fixed to the plane portion 32*g* and located on the side toward the X-axis positive direction, toward an end portion (downstream end portion) of the intra-developer-containing-space transport body 36 fixed on the curved surface portion 32*h* and located on a side toward the top face 32*a* and on the side toward the X-axis positive direction.

As shown in FIG. 2, similar to the upstream transport body 34, the auxiliary transport body 37 is a sheet-like member. The auxiliary transport body 37 is fixed to wall surfaces which demarcate the developer containing space ST with respect to the axial direction. The auxiliary transport body 37 includes a transport-surface counter portion and a carrying-surface counter portion.

The transport-surface counter portion extends along a portion of the intra-developer-containing-space transport body 36 which is located on a side toward the top face 32*a* with respect to a plane which contains the center axis STC of the developer containing space ST and is orthogonal to the Y-axis, and faces the portion of the intra-developer-containing-space transport body 36 with a predetermined distance (in the present embodiment, 1 mm) therebetween.

The carrying-surface counter portion extends towards the Y-axis negative direction from an end portion of the transport-surface counter portion located toward the X-axis positive direction. Through employment of this configuration, the carrying-surface counter portion faces the developer carrying surface DS.

A surface of the auxiliary transport body 37 which faces the intra-developer-containing-space transport surface TSc or the developer carrying surface DS is herein also called an auxiliary transport surface TSd.

Figure 7:
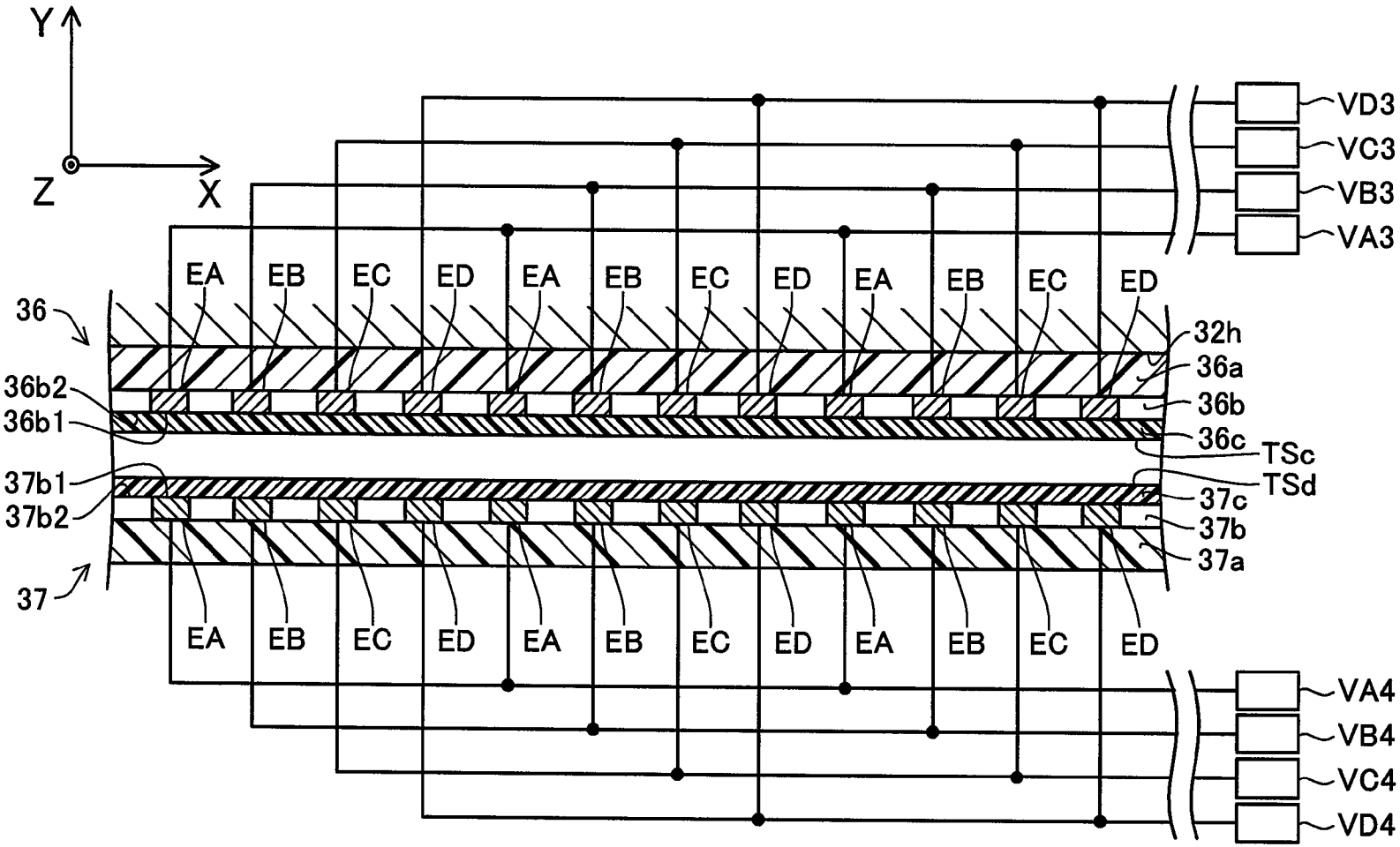
FIG. 7 is an enlarged sectional view partially showing the intra-developer-containing-space transport body and an auxiliary transport body shown in FIG. 2.

As shown in FIG. 7, which is an enlarged view showing a portion of the auxiliary transport body 37 closest to the top face 32*a*, similar to the upstream transport body 34, the auxiliary transport body 37 has a 3-layer structure consisting of: a substrate 37*a*, which is a layer furthest from the intra-developer-containing-space transport surface TSc; an electrode formation layer 37*b*, which is a layer second furthest from the intra-developer-containing-space transport surface TSc after the substrate 37*a*; and a surface film 37*c*, which is a layer closest to the intra-developer-containing-space transport surface TSc. The electrode formation layer 37*b* includes a plurality of electrodes 37*b*1 (or EA, EB, EC, and ED). Power circuits VA4 to VD4 are repeatedly connected in this order to the electrodes 37*b*1 in a one-to-one correspondence from an end portion (upstream end portion) of the auxiliary transport body 37 located on the side toward the X-axis negative direction, toward an end portion (downstream end portion) of the auxiliary transport body 37 located on the side toward the X-axis positive direction.

Referring again to FIG. 1, the charger 41 is disposed so as to face the latent image forming surface LS. The charger 41 is connected to an unillustrated bias circuit. When bias is applied to the charger 41, the charger 41 (in the present embodiment, a scorotron-type charger) uniformly, positively charges the latent image forming surface LS.

The scanner unit 42 has an unillustrated laser beam generator. The laser beam generator generates a laser beam LB on the basis of image data. The scanner unit 42 focuses the generated laser beam LB to (the scanner unit 42 performs exposure to the generated laser beam LB at) a position on the latent image forming surface LS located downstream of the charger 41 and upstream of the developer supply apparatus 32 with respect to the rotational direction of the photoconductor drum 31 (counterclockwise direction in FIG. 1). Furthermore, the scanner unit 42 moves a position on the latent image forming surface LS where the laser beam LB is focused at a uniform speed in a predetermined scanning direction substantially parallel to the Z-axis (the scanner unit 42 performs scanning).

The transfer roller 51 rotates clockwise in FIG. 1. The circumferential surface of the transfer roller 51 is disposed in contact with the latent image forming surface LS of the photoconductor drum 31. The transfer roller 51 is connected to an unillustrated bias circuit. When bias is applied to the transfer roller 51, the developer T adhering to the latent image forming surface LS is transferred onto the surface of the paper P in a state in which the paper P is nipped between the circumferential surface of the transfer roller 51 and the latent image forming surface LS.

The laser printer 10 further includes an unillustrated fixing section, a paper ejection section, and a control section. In the fixing section, the paper P onto which the developer T is transferred is subjected to heat and pressure, whereby the developer T is fixed on the paper P. The paper ejection section has a catch tray. In the paper ejection section, the paper P which has passed the fixing section is transported toward the catch tray and is then held in the catch tray.

The control section is electrically connected to various devices for driving movable members of the laser printer 10, such as motors, actuators, and sensors, to the laser beam generator of the scanner unit 42, to various bias circuits, and to various power circuits, and sends instruction signals thereto at predetermined timings.

<Operation>

Next, the operation of the laser printer 10 configured as mentioned above will be described from the point of time when a user sends the laser printer 10 a printing instruction signal which contains image data indicative of an image which the user wants to form.

Upon reception of the printing instruction signal, the control section controls the photoconductor drum 31 and the transfer roller 51 so as to bring them into a state of rotation (rotating state).

Furthermore, the control section controls the developing roller 33 so as to bring it into a state of rotation (rotating state) at a predetermined roller rotational speed NR (number of revolutions of roller, in the present embodiment, $10/\pi$ (1/s)).

Meanwhile, a developer carrying surface moving speed VR, which is a speed at which the circumferential surface (developer carrying surface DS) of the developing roller 33 moves (i.e., a speed at which an arbitrary point on the developer carrying surface DS moves on a locus having the same shape as that of the aforementioned second closed curve), is obtained by the following expression (1) using the radius RR (10 mm) of the developing roller 33 and the roller rotational speed NR of the developing roller 33. Accordingly, in the present embodiment, the developer carrying surface moving speed VR is 0.2 m/s.

$$VR=2\pi\cdot RR\cdot NR \tag{1}$$

Additionally, the control section controls the charger 41 so as to bring it into a state (bias applied state) in which a predetermined charge bias is applied to the charger 41. By this procedure, a portion of the latent image forming surface LS (circumferential surface of the photoconductor drum 31) which faces the charger 41 is charged in positive polarity (positively charged).

As the photoconductor drum 31 rotates, a portion of the latent image forming surface LS which is located downstream of the charger 41 with respect to the rotational direction of the photoconductor drum 31 (counterclockwise direction in FIG. 1) is uniformly, positively charged. That is, the portion of the latent image forming surface LS assumes a predetermined positive reference electric potential (in the present embodiment, +1,000 V) at every position therein. Additionally, the control section controls the transfer roller 51 so as to bring it to a state (bias applied state) in which a predetermined transfer bias is applied to the transfer roller 51.

Figure 8:
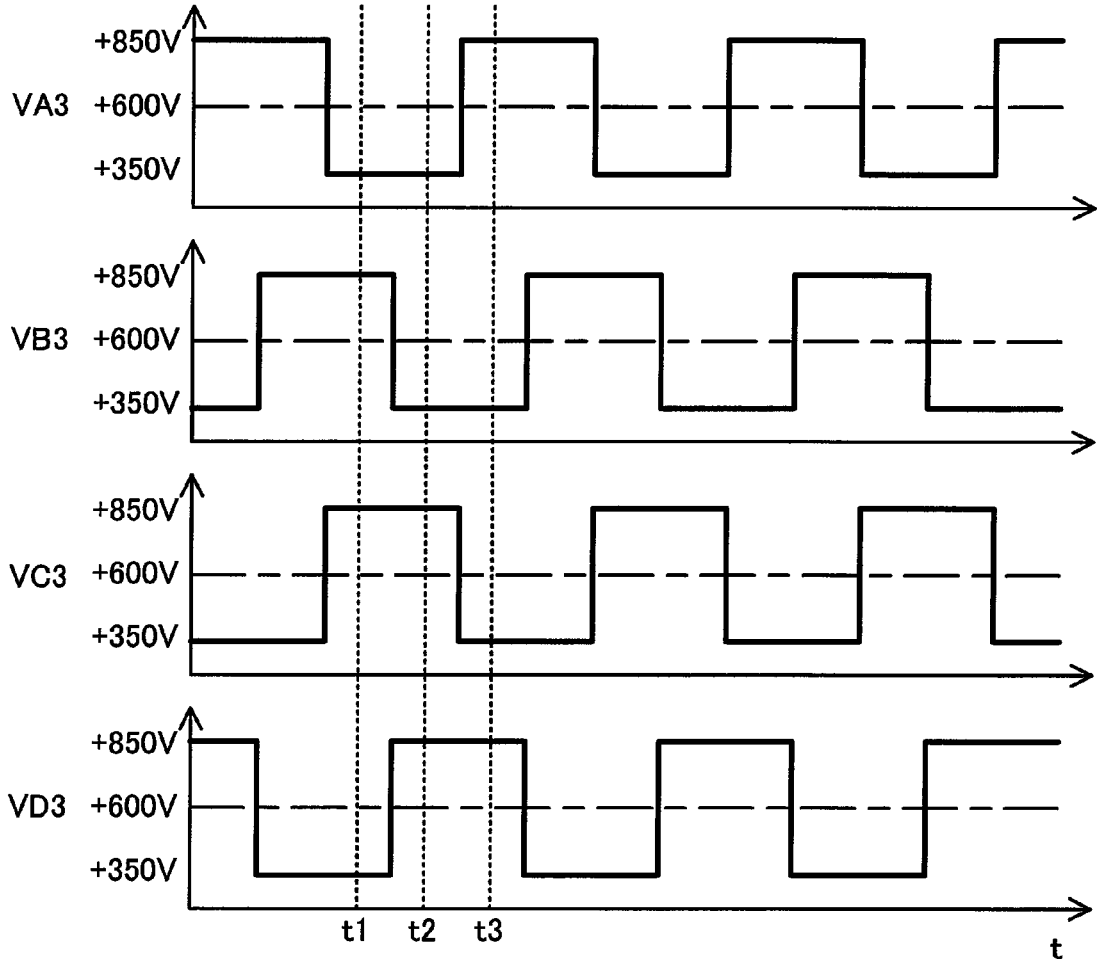
FIG. 8 is a graph showing waveforms of voltages generated by power circuits connected to electrodes of the intra-developer-containing-space transport body shown in FIG. 6.

Furthermore, the control section supplies power to the power circuits VA3 to VD3 connected to the electrodes 36*b*1 of the intra-developer-containing-space transport body 36, thereby generating, in the power circuits VA3 to VD3, square wave voltages having a predetermined amplitude (in the present embodiment, 250 V) and a predetermined positive average voltage (in the present embodiment, +600 V) with a fixed period (in the present embodiment, 4 ms; i.e., a frequency fc of 250 Hz (=reciprocal of period)) as shown in FIG. 8. The power circuits VA3 to VD3 generate voltages whose waveforms shift in phase 90° by 90°. That is, in the order from the power circuit VA3 toward the power circuit VD3, the voltage phase is delayed 90° by 90°.

Thus, for example, at time t1 in FIG. 8, the electric potential of the electrodes EA and ED (+350 V) is lower than that of the electrodes EB and EC (+850 V).

Figure 9:
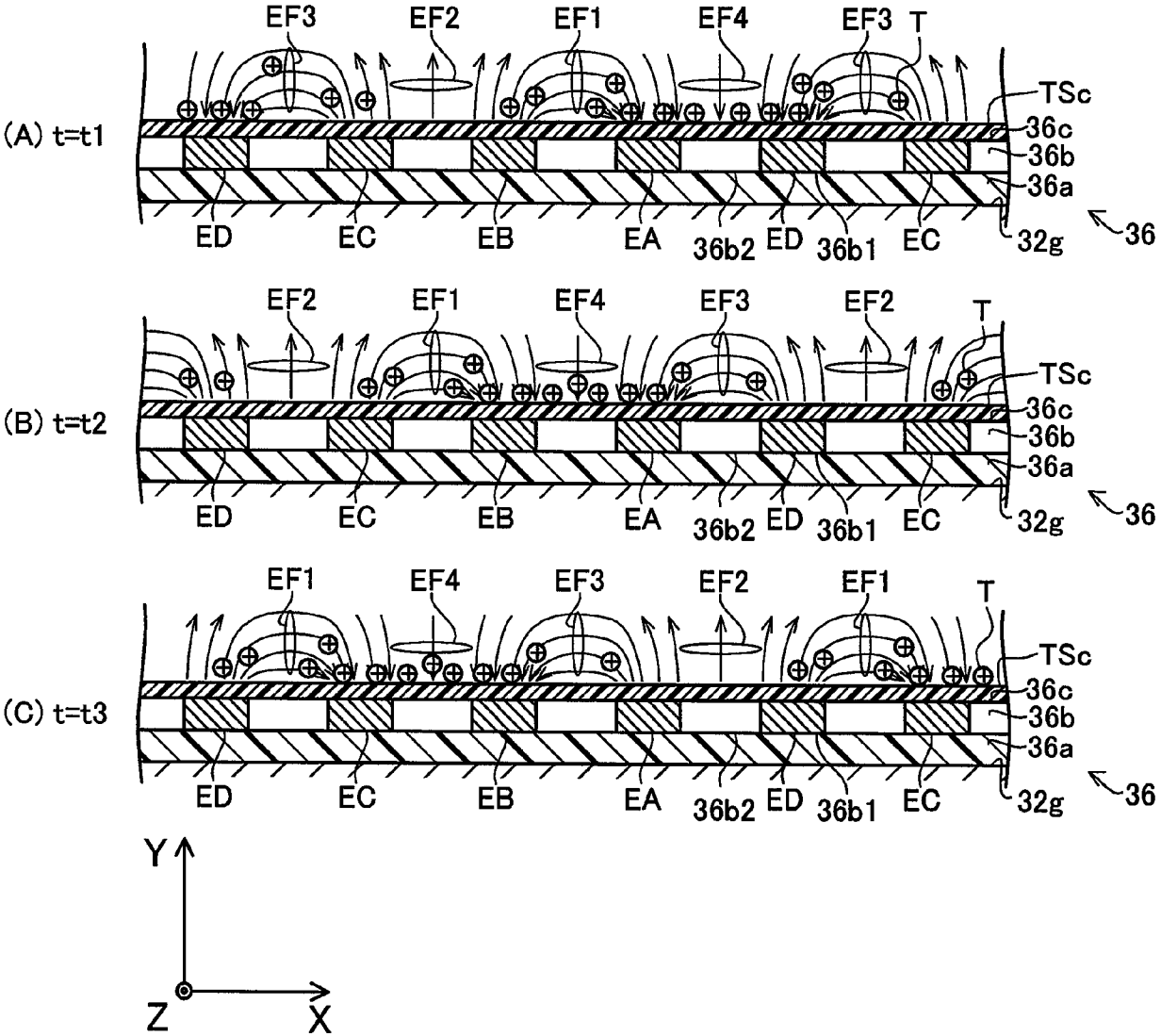
FIG. 9 is an explanatory view showing variations, with time, of electric fields formed on the intra-developer-containing-space transport body shown in FIG. 6.

Accordingly, as shown in view (A) of FIG. 9, which shows time-course variations of electric fields formed in the vicinity of a portion of the intra-developer-containing-space transport body 36 fixed to the plane portion 32*g*, in a space which is in contact with the intra-developer-containing-space transport surface TSc and is located between a portion of the surface film 36*c* in contact with the electrode EA and a portion of the surface film 34*c* in contact with the electrode EB (hereinafter, the space is called merely the "space on the intra-developer-containing-space transport surface TSc between the electrodes EA and EB", and the same convention also applies to other spaces), mainly electric fields EF1 directed in the X-axis positive direction are formed. Thus, the positively charged developer T present in the space are subjected to an electrostatic force of the electric fields EF1 and thus moved in the X-axis positive direction.

Also, in a space on the intra-developer-containing-space transport surface TSc between the electrodes EB and EC, mainly electric fields EF2 directed in the Y-axis positive direction are formed. Thus, the positively charged developer T present in the space are subjected to an electrostatic force of the electric fields EF2 and thus moved in the Y-axis positive direction.

Furthermore, in a space on the intra-developer-containing-space transport surface TSc between the electrodes EC and ED, mainly electric fields EF3 directed in the X-axis negative direction are formed. Thus, the positively charged developer T present in the space are subjected to an electrostatic force of the electric fields EF3 and thus moved in the X-axis negative direction.

Additionally, in a space on the intra-developer-containing-space transport surface TSc between the electrodes ED and EA, mainly electric fields EF4 directed in the Y-axis negative direction are formed. Thus, the positively charged developer T present in the space are subjected to an electrostatic force of the electric fields EF4 and thus moved in the Y-axis negative direction.

Thus, at time t1, the developer T is collected in a space on and in the close vicinity of the intra-developer-containing-space transport surface TSc between the electrodes ED and EA.

Similarly, at time t2 after the elapse of one-fourth period from time t1 (see FIG. 8), the electric potential of the electrodes EA and EB (+350 V) is lower than that of the electrodes EC and ED (+850 V). Thus, as shown in view (B) of FIG. 9, the positively charged developer T is collected in a space on the intra-developer-containing-space transport surface TSc between the electrodes EA and EB.

Also, at time t3 after the elapse of one-fourth period from time t2 (see FIG. 8), the electric potential of the electrodes EB and EC (+350 V) is lower than that of the electrodes ED and EA (+850 V). Thus, as shown in view (C) of FIG. 9, the positively charged developer T is collected in a space on the intra-developer-containing-space transport surface TSc between the electrodes EB and EC.

In this manner, each time a time of one-fourth period elapses, the positively charged developer T is moved by a distance equal to the electrode pitch length DP in the X-axis negative direction along the intra-developer-containing-space transport surface TSc. That is, each time a time of one period elapses, the developer T is moved by a distance of 4·DP (=4·0.2 mm).

Meanwhile, a speed (intra-developer-containing-space transport speed) VTc at which the developer T is transported on the intra-developer-containing-space transport surface TSc is obtained by the following expression (2) using the electrode pitch length DP (=0.2 mm) and the above-mentioned frequency fc (=250 Hz). Accordingly, in the present embodiment, the intra-developer-containing-space transport speed VTc is 0.2 m/s.

$$VTc=4\cdot DP\cdot fc \tag{2}$$

In this manner, the developer T which is positively charged through friction with the intra-developer-containing-space transport surface TSc or mutual friction of the developer T is transported along the intra-developer-containing-space transport surface TSc from an end portion (upstream end portion) of the plane portion 32*g* located on the side toward the X-axis positive direction to an end portion (downstream end portion) of the curved surface portion 32*h* located on the side toward the X-axis positive direction.

Then, when the positively charged developer T reaches the downstream end portion of the intra-developer-containing-space transport body 36, the developer T flies out toward the developer carrying surface DS of the developing roller 33. Thus, a portion of the positively charged developer T adheres to (is carried on) the developer carrying surface DS, and another portion of the positively charged developer T rests on the developer T adhering to the developer carrying surface DS or suspends in the vicinity of the developer carrying surface DS. The other developer T drops in the Y-axis negative direction and is thus returned to the vicinity of an upstream end portion of the intra-developer-containing-space transport surface TSc.

Furthermore, the control section supplies power to the power circuits VA4 to VD4 connected to the electrodes 37*b*1 of the auxiliary transport body 37, thereby generating, in the power circuits VA4 to VD4, voltages similar to those generated in the power circuits VA3 to VD3.

By this procedure, in an area where the intra-developer-containing-space transport surface TSc and the auxiliary transport surface TSd face each other, even when the developer T leaves the intra-developer-containing-space transport surface TSc by the effect of gravity, the developer T reaches the auxiliary transport surface TSd and is transported on the auxiliary transport surface TSd toward an end portion (downstream end portion) of the auxiliary transport surface TSd located on the side toward the X-axis positive direction.

Furthermore, an average voltage (+600 V) obtained by time-averaging voltages generated in the power circuits VA4 to VD4 is higher than the electric potential (+500 V) of the developer carrying surface DS. Thus, average electric fields obtained in the following manner function to move the positively charged developer T present on the auxiliary transport surface TSd from the auxiliary transport surface TSd toward the developer carrying surface DS. The average electric fields are obtained by time-averaging components of electric fields formed in a space between the developer carrying surface DS and a portion of the auxiliary transport surface TSd which is in the vicinity of a downstream end portion of the auxiliary transport surface TSd and faces the developer carrying surface DS, the components being orthogonal to the auxiliary transport surface TSd at respective arbitrary points on the auxiliary transport surface TSd.

Accordingly, the developer T which has been transported on the auxiliary transport surface TSd and has reached the auxiliary transport surface TSd of the carrying-surface counter portion, and a portion of the developer T having flied out from the intra-developer-containing-space transport surface TSc and suspending in a space between the developer carrying surface DS and the auxiliary transport surface TSd of the carrying-surface counter portion are moved toward the developer carrying surface DS. A portion of the positively charged developer T adheres to the developer carrying surface DS; another portion of the positively charged developer T rests on the developer T adhering to the developer carrying surface DS; and the other developer T drops in the Y-axis negative direction and is thus returned to the vicinity of an upstream end portion of the intra-developer-containing-space transport surface TSc.

Additionally, the control section supplies power to the power circuits VA1 to VD1 connected to the electrodes 34*b*1 of the upstream transport body 34, thereby generating, in the power circuits VA1 to VD1, voltages similar to those generated in the power circuits VA3 to VD3 and lower in frequency than those generated in the power circuits VA3 to VD3. In the present embodiment, the average voltage is +600 V; the amplitude is 250 V; and a frequency fa is 200 Hz.

Thus, as in the case of the intra-developer-containing-space transport body 36, electric fields (upstream transport electric fields) for transporting the positively charged developer T from an end portion (upstream end portion) of the upstream transport surface TSa located along the direction of the upstream transport surface TSa and on the side toward the X-axis negative direction (located on an upstream side with respect to the moving direction of the developer carrying surface DS), toward an end portion (downstream end portion) of the upstream transport surface TSa located on the side toward the X-axis positive direction (located on a downstream side with respect to the moving direction of the developer carrying surface DS) are formed in a space between the upstream transport surface TSa and the developer carrying surface DS.

By the effect of the upstream transport electric fields, the developer T which rests on the developer T adhering to the developer carrying surface DS, and a portion of the developer T suspending in the vicinity of the developer carrying surface DS which has reached the upstream end portion of the upstream transport surface TSa are transported on the upstream transport surface TSa from the upstream end portion of the upstream transport surface TSa toward the downstream end portion of the upstream transport surface TSa.

At this time, an upstream transport speed VTa at which the developer T is transported on the upstream transport surface TSa is obtained by an expression ($VTa=4\cdot DP\cdot fa$) similar to the aforementioned Expression (2). In the present embodiment, the upstream transport speed VTa is 0.16 m/s.

Furthermore, as in the case of the intra-developer-containing-space transport body 36, there are also formed electric fields (similar to the electric fields EF2 directed mainly toward the Y-axis positive direction shown in FIG. 9) for moving the positively charged developer T in a direction which is orthogonal to the upstream transport surface TSa and is directed away from the upstream transport surface TSa. By the effect of the electric fields, a portion of the developer T is moved toward the developer carrying surface DS, and the developer T which has thus reached the developer carrying surface DS adheres to the developer carrying surface DS.

Additionally, an average voltage (+600 V) obtained by time-averaging voltages generated in the power circuits VA1 to VD1 is higher than the electric potential (+500 V) of the developer carrying surface DS. Thus, average electric fields obtained in the following manner function to move the positively charged developer T present on the upstream transport surface TSa from the upstream transport surface TSa toward the developer carrying surface DS. The average electric fields are obtained by time-averaging components of the above-mentioned upstream transport electric fields which are orthogonal to the upstream transport surface TSa at respective arbitrary points on the upstream transport surface TSa. Thus, the developer T transported on the upstream transport surface TSa can be more caused to reliably adhere to the developer carrying surface DS. As a result, the developer T which does not adhere to the developer carrying surface DS and reaches the downstream end portion of the upstream transport surface TSa can be reduced in amount, whereby the amount of developer T flying out toward a space in the vicinity of the developing area can be reduced.

Meanwhile, even when the developer T transported on the upstream transport surface TSa does no adhere to the developer carrying surface DS and reaches the downstream end portion of the upstream transport surface TSa, since the upstream transport speed VTa is lower than the developer carrying surface moving speed VR, the speed at which the developer T flies out toward a space in the vicinity of the developing area is lower as compared with the case where the upstream transport speed VTa is equal to the developer carrying surface moving speed VR. Accordingly, an area in which the developer T scatters can be prevented from becoming excessively large. As a result, there can be avoided a problem in that the scattered developer T dirties paper P and component members of the apparatus.

Furthermore, the developer carrying surface moving speed VR and the upstream transport speed VTa differ from each other. Accordingly, when time elapses from a first point of time to a second point of time, a difference arises between the moving distance of a certain portion of the developer carrying surface DS and the moving distance of the developer T present at a portion of the upstream transport surface TSa which faces the certain portion of the developer carrying surface DS at the first point of time. That is, in the case where distribution unevenness exists with respect to the developer T on the upstream transport surface TSa, the distribution of the developer T present at a portion of the upstream transport surface TSa which faces the certain portion of the developer carrying surface DS varies with the elapse of time. As a result, as compared with the case where the developer carrying surface moving speed VR and the upstream transport speed VTa are equal to each other, the degree of influence of the distribution unevenness of the developer T on the upstream transport surface TSa on the distribution of the developer T adhering to the developer carrying surface DS can be reduced. Therefore, the distribution of the developer T on the developer carrying surface DS can be brought close to uniform distribution.

Incidentally, immediately after the control section receives a printing instruction signal, the latent image forming surface LS assumes a reference electric potential (+1,000 V) at every position thereon. On the other hand, the developer carrying surface DS assumes an electric potential (+500 V) lower than the reference electric potential. Accordingly, in a space between the developer carrying surface DS and the latent image forming surface LS, electric fields directed from the latent image forming surface LS toward the developer carrying surface DS are formed at all positions on the latent image forming surface LS. As a result, the positively charged developer T is subjected to an electrostatic force directed from the latent image forming surface LS toward the developer carrying surface DS. As a result, the developer T does not move toward the latent image forming surface LS, but remains adhering to the developer carrying surface DS and moves with the developer carrying surface DS. Then, the developer T reaches an area where the developer carrying surface DS and the downstream transport surface TSb face each other.

Meanwhile, the control section supplies power to the power circuits VA2 to VD2 connected to the electrodes 35*b*1 of the downstream transport body 35, thereby generating, in the power circuits VA2 to VD2, voltages similar to those generated in the power circuits VA3 to VD3 and lower in average voltage and higher in frequency than those generated in the power circuits VA3 to VD3. In the present embodiment, the average voltage is +400 V; the amplitude is 250 V; and a frequency fb is 300 Hz.

Thus, as in the case of the intra-developer-containing-space transport body 36, there are formed electric fields (similar to the electric fields EF4 directed mainly toward the Y-axis negative direction shown in FIG. 9) for moving the positively charged developer T in a direction which is orthogonal to the downstream transport surface TSb and is directed toward the downstream transport surface TSb. As a result, a portion of the developer T adhering to the developer carrying surface DS is pulled off (removed) from the developer carrying surface DS and moves toward the downstream transport surface TSb.

Additionally, an average voltage (+400 V) obtained by time-averaging voltages generated in the power circuits, VA2 to VD2 is lower than the electric potential (+500 V) of the developer carrying surface DS. Thus, average electric fields obtained in the following manner function to move the positively charged developer T present on the developer carrying surface DS from the developer carrying surface DS toward the downstream transport surface TSb. The average electric fields are obtained by time-averaging components of the above-mentioned downstream transport electric fields which are orthogonal to the downstream transport surface TSb at respective arbitrary points on the downstream transport surface TSb.

Thus, the developer T which has not moved to the latent image forming surface LS and remains adhering to the developer carrying surface DS can be reliably removed from the developer carrying surface DS in an area located downstream of the developing area, thereby preventing the developer T from reaching an area located upstream of the developing area while remaining adhering to the developer carrying surface DS. Therefore, the distribution of the developer T on the developer carrying surface DS in the area located upstream of the developing area can be brought closer to uniform distribution. As a result, in performance of development to be described later, a deterioration in the quality of an image formed in the developer T adhering to the latent image forming surface LS (occurrence of a developing ghost or the like) can be avoided.

Furthermore, as in the case of the intra-developer-containing-space transport body 36, electric fields (downstream transport electric fields) for transporting the positively charged developer T on the downstream transport surface TSb from an end portion (upstream end portion) of the downstream transport surface TSb located along the direction of the downstream transport surface TSb and on the side toward the X-axis positive direction (located on the upstream side with respect to the moving direction of the developer carrying surface DS), toward an end portion (downstream end portion) of the downstream transport surface TSb located on the side toward the X-axis negative direction (located on the downstream side with respect to the moving direction of the developer carrying surface DS) are formed in a space between the downstream transport surface TSb and the developer carrying surface DS. By the effect of the downstream transport electric fields, the developer T which has been pulled off (removed) from the developer carrying surface DS, and a portion of the developer T suspending (scattering) in the vicinity of the developing area which has reached the downstream transport surface TSb are transported on the downstream transport surface TSb from the upstream end portion of the downstream transport surface TSb toward the downstream end portion of the downstream transport surface TSb.

At this time, a downstream transport speed VTb at which the developer T is transported on the downstream transport surface TSb is obtained by an expression ($VTb=4\cdot DP\cdot fb$) similar to the aforementioned Expression (2). In the present embodiment, the downstream transport speed VTb (=0.24 m/s) is higher than the upstream transport speed VTa.

Meanwhile, even when the developer T which does not adhere to the latent image forming surface LS and reaches the downstream transport surface TSb is relatively large in amount, since the developer T on the downstream transport surface TSb is transported at the downstream transport speed VTb higher than the upstream transport speed VTa, the stagnation of the developer T at the upstream end portion of the downstream transport surface TSb can be prevented more reliably than in the case where the developer T on the downstream transport surface TSb is transported at the upstream transport speed VTa. Accordingly, a hindrance to the collection of the developer T can be avoided. As a result, since an increase in the amount of the developer T scattering in a space in the vicinity of the developing area can be restrained, adhesion of the developer T to the latent image forming surface LS at improper positions can be prevented.

Furthermore, the developer carrying surface moving speed VR and the downstream transport speed VTb differ from each other. Accordingly, when time elapses from a first point of time to a second point of time, a difference arises between the moving distance of a certain portion of the developer carrying surface DS and the moving distance of the developer T present at a portion of the downstream transport surface TSb which faces the certain portion of the developer carrying surface DS at the first point of time. That is, the distribution of the developer T present at a portion of the downstream transport surface TSb which faces the certain portion of the developer carrying surface DS varies with the elapse of time. As a result, the distribution of the developer T on the downstream transport surface TSb can be brought close to uniform distribution. Therefore, the concentration of the developer T in an arbitrary area on the downstream transport surface TSb can be prevented from becoming excessively high, thereby avoiding occurrence of difficulty in transport of the developer T which could otherwise result from aggregation of the developer T.

Also, as described with reference to FIG. 4, the distance Da is longer than the distance Db and the distance Dc. That is, the distance between the downstream transport surface TSb and the developer carrying surface DS as measured at the upstream portion TSb1 of the downstream transport surface TSb is longer than that as measured at the other portion (i.e., wide-mouthed). By virtue of this, the developer T scattering in a space in the vicinity of the developing area can be collected in a larger amount. Therefore, the amount of the developer T scattering in the space can be more reduced.

Meanwhile, the distance Dc is shorter than the distance Da and the distance Db. That is, the distance between the downstream transport surface TSb and the developer carrying surface DS as measured at the downstream portion TSb3 of the downstream transport surface TSb is shorter than that as measured at the other portion (i.e., narrow-mouthed). Thus, electric fields directed from the developer carrying surface DS toward the downstream transport surface TSb become relatively strong. As a result, the developer T which adheres to the developer carrying surface DS at a portion corresponding to the downstream portion TSb3 can be more reliably pulled off from the developer carrying surface DS.

When the developer T transported on the downstream transport surface TSb reaches the downstream end portion of the downstream transport surface TSb, the developer T is returned onto the intra-developer-containing-space transport surface TSc.

In this state, the control section causes the scanner unit 42 to output the laser beam LB on the basis of image data at predetermined timing. The output laser beam LB is focused at a position on the latent image forming surface LS corresponding to the image data. Thus, the latent image forming surface LS is exposed to light at the position where the laser beam LB is focused, whereby the absolute value of the amount of charge at the position reduces. As a result, the electric potential of the latent image forming surface LS at the exposed position drops to a level (in the present embodiment, +100 V) closer to the electric potential (0 V) of the drum body 31*a* than to the reference electric potential (+1,000 V). In this manner, an electrostatic latent image is formed on the latent image forming surface LS by means of electric potential of the latent image forming surface LS.

When, as a result of rotation of the photoconductor drum 31, the formed electrostatic latent image faces the developing hole 32*c*1 opened in the front face 32*c*, electric fields which are directed from the developer carrying surface DS toward the latent image forming surface LS are formed for positions having been exposed to the laser beam LB (exposed positions) on the electrostatic latent image. As a result, by the effect of an electrostatic force generated on the basis of the electric fields and the charge (amount of charge) of the developer T, the developer T moves from the developer carrying surface DS toward the latent image forming surface LS and reaches the latent image forming surface LS through the developing hole 32*c*1. That is, the developer T is supplied to the latent image forming surface LS.

Then, the developer T which has reached the latent image forming surface LS adheres to the latent image forming surface LS only at positioned having been exposed to the laser beam LB (exposed positions). By this procedure, the electrostatic latent image formed on the latent image forming surface LS is developed by the developer T, whereby an image in the developer T is formed on the latent image forming surface LS.

Also, through control of the resist rollers 21 and 22*m*, the control section transports the paper P toward an area between the photoconductor drum 31 and the transfer roller 51 at predetermined timing at which coincidence is established between the image in the developer T formed on the latent image forming surface LS and a position on the paper P where the image is to be transferred.

Then, when the paper P reaches a transfer processing position (where the latent image forming surface LS and the transfer roller 51 are in contact with each other) (when the paper P is nipped between the latent image forming surface LS of the photoconductor drum 31 and the circumferential surface of the transfer roller 51), the developer T adhering to the latent image forming surface LS moves onto the paper P and adheres to the paper P at the transfer processing position. In this manner, the developed image in the developer T on the latent image forming surface LS is transferred onto the paper P.

Next, when the paper P reaches the fixing section, the developer T transferred onto the paper P is subjected to heat and pressure. As a result, the developer T transferred onto the paper P is fixed on the paper P. Subsequently, when the paper P is transported and then reaches the paper ejection section, the paper P is ejected toward the catch tray.

Upon completion of ejection of the paper P, the control section stops rotating the photoconductor drum 31, the developing roller 33, and the transfer roller 51. Furthermore, the control section controls the charger 41, the developing roller 33, and the transfer roller 51 so as to change their operation mode from a bias applied state to a state in which bias is not allied (bias unapplied state).

By the above-mentioned procedure, the laser printer 10 forms (prints), on the paper P, an image (graphic image) represented by image data contained in the printing instruction signal which a user has sent out.

As described above, according to the embodiment of the image forming apparatus and the developer supply apparatus of the present invention, the developer T is transported on the upstream transport surface TSa at a relatively low upstream transport speed VTa. Thus, when the developer T transported on the upstream transport surface TSa does not adhere to the developer carrying surface DS and reaches the downstream end portion of the upstream transport surface TSa, a speed at which the developer T flies out toward a space in the vicinity of the developing area is lowered. Accordingly, an area in which the developer T scatters can be prevented from becoming excessively large. As a result, there can be avoided a problem in that the scattered developer T dirties the paper P and component members of the apparatus.

Furthermore, according to the above-described embodiment, even when the developer T which does not adhere to the latent image forming surface LS and reaches the downstream transport surface TSb is relatively large in amount, since the developer T on the downstream transport surface TSb is transported at a relatively high downstream transport speed VTb, there can be prevented the stagnation of the developer T at the upstream end portion of the downstream transport surface TSb. Thus, a hindrance to the collection of the developer T can be avoided. As a result, since an increase in the amount of the developer T scattering in a space in the vicinity of the developing area can be restrained, adhesion of the developer T to the latent image forming surface LS at improper positions can be prevented, thereby avoiding a deterioration in the quality of an image formed in the developer T on the latent image forming surface LS.

The present invention is not limited to the above-described embodiment, but may be modified in various other forms without departing from the scope of the invention. For example, the developer supply apparatus in the embodiment may be applied to an image forming apparatus which includes a plurality of groups each consisting of a process unit and a scanner unit and can perform color printing.

Also, the above-described embodiment is configured such that the developer T is positively charged, but may be configured such that the developer T is negatively charged. In this case, preferably, the photoconductive layer 31*b* is formed of a negatively chargeable photoconductor; the polarity of bias applied to the developing roller 33, the charger 41, and the transfer roller 51 is reverse to that in the embodiment; and the polarity of voltages generated in the power circuits VA1 to VD4 is also reverse to that in the embodiment.

Furthermore, in the above-described embodiment, the upstream transport body 34, the downstream transport body 35, and the intra-developer-containing-space transport body 36 may be formed integrally such that the upstream end portion of the upstream transport body 34 and the downstream end portion of the intra-developer-containing-space transport body 36 are connected to each other and such that the downstream end portion of the downstream transport body 35 and the upstream end portion of the intra-developer-containing-space transport body 36 are connected to each other.

The above-described embodiment is configured such that, in the developing area, a predetermined distance exists between the developer carrying surface DS and the latent image forming surface LS, but may be configured such that the developer carrying surface DS and the latent image forming surface LS are in contact with each other.

Meanwhile, in the above-described embodiment, voltages generated in the power circuits VA1 to VD4 assume a square waveform. However, the voltages may assume a waveform of another shape, such as a sinusoidal waveform or a triangular waveform.

The above-described embodiment is configured such that four power circuits (VA1 to VD1, VA2 to VD2, VA3 to VD3, or VA4 to VD4) are connected to each of four transport bodies; namely, the upstream transport body 34, the downstream transport body 35, the intra-developer-containing-space transport body 36, and the auxiliary transport body 37 and such that voltages generated by the power circuits connected to a single transport body shift in phase 90° by 90°. However, the configuration may be such that three power circuits are connected to each of the four transport bodies and such that voltages generated by the power circuits shift in phase 120° by 120°.

Furthermore, in the above-described embodiment, when the roller rotational speed NR is changed, preferably, the frequencies of voltages generated in the power circuits VA1 to VD4 are changed according to the roller rotational speed NR.

In the above-described embodiment, two transport bodies; namely, the upstream transport body 34 and the downstream transport body 35, differ in the frequency of voltages generated in the power circuits (VA1 to VD1 and VA2 to VD2) connected thereto; in other words, the frequency (fa) for the former and the frequency (fb) for the latter are set to different values, whereby two transport speeds; namely, the upstream transport speed VTa and the downstream transport speed VTb, are controlled so as to assume different values. However, the two transport speeds may be controlled by means of imparting different values to the electrode pitch lengths DP of the two transport bodies.

In the above-described embodiment, the latent image carrying body is implemented by the photoconductor drum 31. However, the latent image carrying body may be implemented by a plurality of drive rollers each having an axis parallel to a center axis DC of the developing roller 33, and a photoconductor belt looped around and mounted on the drive rollers. In this case, as viewed on the section of the photoconductor belt cut by a plane orthogonal to the center axis DC of the developing roller 33, the outer circumferential surface of the photoconductor belt serves as the first closed curve.

In the above-described embodiment, the developer carrying body is implemented by the developing roller 33. However, the developer carrying body may be implemented by a plurality of drive rollers each having an axis parallel to the center axis LC of the photoconductor drum 31, and a developer belt looped around and mounted on the drive rollers. In this case, as viewed on the section of the developer belt cut by a plane orthogonal to the center axis LC of the photoconductor drum 31, the outer circumferential surface of the developer belt serves as the second closed curve.

The invention claimed is:

1. An image forming apparatus comprising a latent image carrying body having a latent image forming surface which is an outer surface of a solid figure formed by arranging a first closed curve present on a plane in a continuously and repeatedly juxtaposed fashion in a direction orthogonal to the plane and on which an electrostatic latent image corresponding to an image to be formed is formed, and developer supply means for supplying a developer charged in a predetermined polarity to the latent image forming surface so as to cause the developer to adhere to the latent image forming surface at positions corresponding to the electrostatic latent image, the image forming apparatus forming the image on a recording medium by means of the developer adhering to the latent image forming surface, wherein the developer supply means comprises:

a developer carrying body having a developer carrying surface which is an outer surface of a solid figure formed by arranging a second closed curve present on the plane in a continuously and repeatedly juxtaposed fashion in the direction orthogonal to the plane and which carries the developer charged in the polarity thereon and faces the latent image forming surface in a predetermined developing area, and adapted to move the developer carrying surface such that an arbitrary point on the developer carrying surface moves unidirectionally on a locus having the same shape as that of the second closed curve;

upstream developer transport means having an upstream transport surface disposed in such a manner as to face, with a predetermined distance therebetween, a portion of the developer carrying surface located upstream of the developing area with respect to a moving direction of the developer carrying surface, and adapted to form, in a space between the upstream transport surface and the developer carrying surface, upstream transport electric fields for moving the developer charged in the polarity on the upstream transport surface at a predetermined upstream transport speed from an upstream side toward a downstream side with respect to the moving direction of the developer carrying surface; and downstream developer transport means having a downstream transport surface disposed in such a manner as to face, with a predetermined distance therebetween, a portion of the developer carrying surface located downstream of the developing area with respect to the moving direction of the developer carrying surface, and adapted to form, in a space between the downstream transport surface and the developer carrying surface, downstream transport electric fields for moving the developer charged in the polarity on the downstream transport surface at a downstream transport speed higher than the upstream transport speed from the upstream side toward the downstream side with respect to the moving direction of the developer carrying surface.

2. An image forming apparatus according to claim 1, wherein the upstream transport speed in the upstream developer transport means is lower than the moving speed of the developer carrying surface.

3. An image forming apparatus according to claim 2, wherein the downstream transport speed in the downstream developer transport means is higher than the moving speed of the developer carrying surface.

4. An image forming apparatus according to claim 3, wherein the upstream developer transport means forms the upstream transport electric fields such that average electric fields obtained by time-averaging components of the upstream transport electric fields which are orthogonal to the upstream transport surface at respective arbitrary points on the upstream transport surface function to move the developer charged in the polarity present on the upstream transport surface from the upstream transport surface toward the developer carrying surface.

5. An image forming apparatus according to claim 4, wherein the downstream developer transport means forms the downstream transport electric fields such that average electric fields obtained by time-averaging components of the downstream transport electric fields which are orthogonal to the downstream transport surface at respective arbitrary points on the downstream transport surface function to move the developer charged in the polarity present on the developer carrying surface from the developer carrying surface toward the downstream transport surface.

6. An image forming apparatus according to claim 1, wherein the downstream transport speed in the downstream developer transport means is higher than the moving speed of the developer carrying surface.

7. An image forming apparatus according to claim 6, wherein the upstream developer transport means forms the upstream transport electric fields such that average electric fields obtained by time-averaging components of the upstream transport electric fields which are orthogonal to the upstream transport surface at respective arbitrary points on the upstream transport surface function to move the developer charged in the polarity present on the upstream transport surface from the upstream transport surface toward the developer carrying surface.

8. An image forming apparatus according to claim 7, wherein the downstream developer transport means forms the downstream transport electric fields such that average electric fields obtained by time-averaging components of the downstream transport electric fields which are orthogonal to the downstream transport surface at respective arbitrary points on the downstream transport surface function to move the developer charged in the polarity present on the developer carrying surface from the developer carrying surface toward the downstream transport surface.

9. An image forming apparatus according to claim 1, wherein the upstream developer transport means forms the upstream transport electric fields such that average electric fields obtained by time-averaging components of the upstream transport electric fields which are orthogonal to the upstream transport surface at respective arbitrary points on the upstream transport surface function to move the developer charged in the polarity present on the upstream transport surface from the upstream transport surface toward the developer carrying surface.

10. An image forming apparatus according to claim 9, wherein the downstream developer transport means forms the downstream transport electric fields such that average electric fields obtained by time-averaging components of the downstream transport electric fields which are orthogonal to the downstream transport surface at respective arbitrary points on the downstream transport surface function to move the developer charged in the polarity present on the developer carrying surface from the developer carrying surface toward the downstream transport surface.

11. A developer supply apparatus comprising:

a developer carrying body having a developer carrying surface which is an outer surface of a solid figure formed by arranging a second closed curve present on a plane in a continuously and repeatedly juxtaposed fashion in a direction orthogonal to the plane and which carries a developer charged in a predetermined polarity thereon and faces, in a predetermined developing area, a latent image forming surface which is an outer surface of a solid figure formed by arranging a first closed curve present on the plane in a continuously and repeatedly juxtaposed fashion in the direction orthogonal to the plane and on which an electrostatic latent image is formed, and adapted to move the developer carrying surface such that an arbitrary point on the developer carrying surface moves unidirectionally on a locus having the same shape as that of the second closed curve;

upstream developer transport means having an upstream transport surface disposed in such a manner as to face, with a predetermined distance therebetween, a portion of the developer carrying surface located upstream of the developing area with respect to a moving direction of the developer carrying surface, and adapted to form, in a space between the upstream transport surface and the developer carrying surface, upstream transport electric fields for moving the developer charged in the polarity on the upstream transport surface at a predetermined upstream transport speed from an upstream side toward a downstream side with respect to the moving direction of the developer carrying surface; and downstream developer transport means having a downstream transport surface disposed in such a manner as to face, with a predetermined distance therebetween, a portion of the developer carrying surface located downstream of the developing area with respect to the moving direction of the developer carrying surface, and adapted to form, in a space between the downstream transport surface and the developer carrying surface, downstream transport electric fields for moving the developer charged in the polarity on the downstream transport surface at a downstream transport speed higher than the upstream transport speed from the upstream side toward the downstream side with respect to the moving direction of the developer carrying surface;

the developer supply apparatus supplying the developer charged in the polarity and carried on the developer carrying surface to the latent image forming surface in the developing area so as to cause the supplied developer to adhere to the latent image forming surface at positions corresponding to the electrostatic latent image.

12. A developer supply apparatus according to claim 11, wherein the upstream transport speed in the upstream developer transport means is lower than the moving speed of the developer carrying surface.

13. A developer supply apparatus according to claim 12, wherein the downstream transport speed in the downstream developer transport means is higher than the moving speed of the developer carrying surface.

14. A developer supply apparatus according to claim 13, wherein the upstream developer transport means forms the upstream transport electric fields such that average electric fields obtained by time-averaging components of the upstream transport electric fields which are orthogonal to the upstream transport surface at respective arbitrary points on the upstream transport surface function to move the developer charged in the polarity present on the upstream transport surface from the upstream transport surface toward the developer carrying surface.

15. A developer supply apparatus according to claim 14, wherein the downstream developer transport means forms the downstream transport electric fields such that average electric fields obtained by time-averaging components of the downstream transport electric fields which are orthogonal to the downstream transport surface at respective arbitrary points on the downstream transport surface function to move the developer charged in the polarity present on the developer carrying surface from the developer carrying surface toward the downstream transport surface.

16. A developer supply apparatus according to claim 11, wherein the downstream transport speed in the downstream developer transport means is higher than the moving speed of the developer carrying surface.

17. A developer supply apparatus according to claim 16, wherein the upstream developer transport means forms the upstream transport electric fields such that average electric fields obtained by time-averaging components of the upstream transport electric fields which are orthogonal to the upstream transport surface at respective arbitrary points on the upstream transport surface function to move the developer charged in the polarity present on the upstream transport surface from the upstream transport surface toward the developer carrying surface.

18. A developer supply apparatus according to claim 17, wherein the downstream developer transport means forms the downstream transport electric fields such that average electric fields obtained by time-averaging components of the downstream transport electric fields which are orthogonal to the downstream transport surface at respective arbitrary points on the downstream transport surface function to move the developer charged in the polarity present on the developer carrying surface from the developer carrying surface toward the downstream transport surface.

19. A developer supply apparatus according to claim 11, wherein the upstream developer transport means forms the upstream transport electric fields such that average electric fields obtained by time-averaging components of the upstream transport electric fields which are orthogonal to the upstream transport surface at respective arbitrary points on the upstream transport surface function to move the developer charged in the polarity present on the upstream transport surface from the upstream transport surface toward the developer carrying surface.

20. A developer supply apparatus according to claim 19, wherein the downstream developer transport means forms the downstream transport electric fields such that average electric fields obtained by time-averaging components of the downstream transport electric fields which are orthogonal to the downstream transport surface at respective arbitrary points on the downstream transport surface function to move the developer charged in the polarity present on the developer carrying surface from the developer carrying surface toward the downstream transport surface.

* * * * *